US011313147B1

(12) United States Patent
Maher

(10) Patent No.: US 11,313,147 B1
(45) Date of Patent: Apr. 26, 2022

(54) WATER-FILLABLE PORTABLE MODULAR PRIVACY FENCE

(71) Applicant: Michael B. Maher, Wilton Manors, FL (US)

(72) Inventor: Michael B. Maher, Wilton Manors, FL (US)

( * ) Notice: Subject to any disclaimer, the term of this patent is extended or adjusted under 35 U.S.C. 154(b) by 0 days.

(21) Appl. No.: 16/934,967

(22) Filed: Jul. 21, 2020

Related U.S. Application Data

(63) Continuation-in-part of application No. 16/390,546, filed on Apr. 22, 2019, now Pat. No. 10,718,133.

(51) Int. Cl.

| | |
|---|---|
| ***E01F 13/02*** | (2006.01) |
| ***E04H 17/22*** | (2006.01) |
| ***E04H 17/14*** | (2006.01) |
| ***E04H 17/16*** | (2006.01) |

(52) U.S. Cl.
CPC ..... *E04H 17/22* (2013.01); *E01F 13/022* (2013.01); *E04H 17/1417* (2013.01); *E04H 17/168* (2013.01)

(58) Field of Classification Search
CPC . E04H 17/1413; E04H 17/1456; E04H 17/16; E04H 17/168; E04H 17/18; E04H 17/22; E01F 13/02; E01F 13/022
See application file for complete search history.

(56) References Cited

U.S. PATENT DOCUMENTS

| | | | | |
|---|---|---|---|---|
| 4,854,767 | A * | 8/1989 | Sasaki | E01F 8/0064 404/6 |
| 6,004,218 | A * | 12/1999 | Keating | A63C 19/06 256/24 |
| 8,919,741 | B2 * | 12/2014 | Sadinsky | E04H 17/163 256/26 |
| 9,856,674 | B1 * | 1/2018 | Pond | E04H 17/20 |
| 2008/0277639 | A1 * | 11/2008 | Huang | E04H 17/168 256/24 |
| 2017/0058557 | A1 * | 3/2017 | Wu | E04H 17/22 |

* cited by examiner

*Primary Examiner* — Michael P Ferguson
(74) *Attorney, Agent, or Firm* — Glenn E. Gold, P.A.; Glenn E. Gold

(57) ABSTRACT

A modular fence unit integrates a base, a pair of end posts extending through slots formed in the base, and a fence panel design resting above the base between the pair of end posts. A tongue and groove combination provides the joint used to situate the fence panel design between the posts. The joint enables the fence panels to be releasably attachable to the end posts. The fence unit can incorporate a single panel, multiple vertically-oriented panels arranged horizontally, or multiple horizontally-oriented panels arranged vertically. The base includes an interior compartment space capable of holding fluid, such as liquid, to enable the base to serve as stabilizing ballast.

6 Claims, 18 Drawing Sheets

WATER-FILLABLE PORTABLE MODULAR PRIVACY FENCE

CROSS-REFERENCE TO RELATED APPLICATION

This Applications is a continuation-in-part of co-pending U.S. patent application Ser. No. 16/390,546 filed on Apr. 22, 2019, the entire contents of which are incorporated by reference herein.

FIELD OF THE INVENTION

The present invention relates generally to privacy fence constructions, and, more particularly, to the design of modular fence units that can be readily assembled, disassembled, and transported as portable units.

BACKGROUND OF THE INVENTION

Fences have well known constructions that are used in a variety of settings. For example, a property owner may use a fence to establish property boundaries, alert outsiders to where the periphery of the property is located, and impede trespassers. With a privacy fence, however, an additional level of privacy is desired, in which the homeowner, for example, desires to conceal the dwelling or yard (or a portion thereof) from direct line-of-sight viewing from passerby's and the like. A privacy fence combines a barrier-type feature to prohibit—or at least limit—viewing from one side of the fence to the other, and a height feature to ensure that viewing over the fence is difficult—if not impossible. The degree to which a view is blocked can be modified based on the particular fence construction, such as the spacing of picket planks.

There are many different styles of privacy fences, made from a variety of materials, such as wood, metal and plastic. Privacy fences are distinguishable from ordinary fences in that their purpose is to offer a shield from the outside world. Typically, privacy fences are at least 4 to 6 feet tall.

There are a variety of settings where it would useful for an individual to have the ability to easily, efficiently, and quickly assemble a privacy fence on a ground surface (such as a residential yard), while sufficiently stable to withstand windy conditions. Furthermore, it would be desirable to provide such a privacy fence assembly which, when disassembled, could be compactly stored without taking up much space, easily packaged for transportation/shipping, readily unpackaged, and easily reassembled. Furthermore, it would be beneficial if the disassembled product was relatively lightweight to facilitate ease of transportation and low shipping costs.

It would be further desirable to provide such a privacy fence having a construction lending itself to being made in a variety of form factors incorporating any of a variety of sizes, colors, styles, and the like.

Furthermore, it would be beneficial to provide such a portable privacy fence system incorporating components enabling an individual to quickly and easily releasably attach two or more modular units to one another depending upon the needs and desires of the individual.

Accordingly, there is a long-felt, but as-of-yet unmet, need for a privacy fence design that features modularity, portability, and ease of disassembly and reassembly.

SUMMARY OF THE INVENTION

The present invention is directed to a modular fence system incorporating individual fence units integrating a pair of end posts, a base, and a fence panel structure/design with a set of releasable joint-type fittings, enabling the components to be readily connected and disconnected, or releasably connected, to one another. The fence unit may incorporate a single, unitary panel structure, a plurality of vertically-oriented panels arranged horizontally, or multiple horizontally-oriented panels arranged vertically. Significantly, the base includes a hollow interior compartment space capable of holding fluid ballast enabling the base to serve as a stabilizing component. As one type of joint, a tongue-and-groove combination enables the fence panels to be releasably attachable to the end posts.

In one aspect of the present invention, a fence assembly includes at least one fence unit, wherein each fence unit comprises:

a fence panel including a frame and a plurality of pickets supported by the frame;

the frame including a pair of spaced-apart end supports and a pair of spaced-apart rails extending between the pair of end supports, the plurality of pickets extending between the pair of frame rails;

a pair of end posts releasably attachable to the frame at the pair of end supports, each end post associated with a respective frame end support;

a pair of joint configurations each defining the releasable attachment between an associated pair of end post and frame end support; and a base including a pair of post-receiving slots disposed at opposite ends of the base and configured to seatably receive the pair of end posts extending through the pair of post-receiving slots.

In another aspect, a fence assembly may include at least one fence unit, wherein each fence unit comprises:

a plurality of fence panels distributed into a set of inner panels and a pair of outer end panels bracketing the set of inner panels;

at least one downwardly depending locating pin extending from a bottom side of a respective inner panel;

a pair of end posts releasably attachable to the pair of outer end panels, each end post associated with a respective outer end panel;

a pair of first joint configurations each defining the releasable attachment between an associated pair of end post and outer end panel;

a plurality of second joint configurations each defined at an interface between an associated pair of adjacent inner panels and configured to enable alignment therebetween;

a base including a pair of post-receiving slots disposed at opposite ends of the base and configured to seatably receive the pair of end posts extending through the pair of post-receiving slots; and at least one cavity each formed in a top side of the base and disposed to receive a respective corresponding one of the at least one locating pin of a respective inner panel.

In yet another aspect of the present invention, a fence assembly includes at least one fence unit, wherein each fence unit comprises:

a pair of end posts;

a base including a pair of post-receiving slots disposed at opposite ends of the base and configured to seatably receive the pair of end posts extending through the pair of post-receiving slots; and a plurality of fence panels extending between the pair of end posts and disposed in a generally vertical stacking arrangement;

a pair of fittings of a first type each defined at an inner side of a respective one of the pair of end posts;

a plurality of fittings of a second type matingly complementary to the first type and grouped in pairs each defined at opposing ends of a respective one of the plurality of fence panels and disposed in opposition to the inner sides of the pair of end posts; and a mateable relationship between the plurality of second type fittings of the plurality of fence panels and the pair of first type fittings of the pair of end posts in order to deploy the plurality of fence panels in the vertical stacking arrangement.

These and other aspects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings, provided to illustrate and not to limit the invention, in which.

Like reference numerals refer to like parts throughout the several views of the drawings.

DETAILED DESCRIPTION OF PREFERRED IMPLEMENTATIONS

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figures 5, 6, 7:
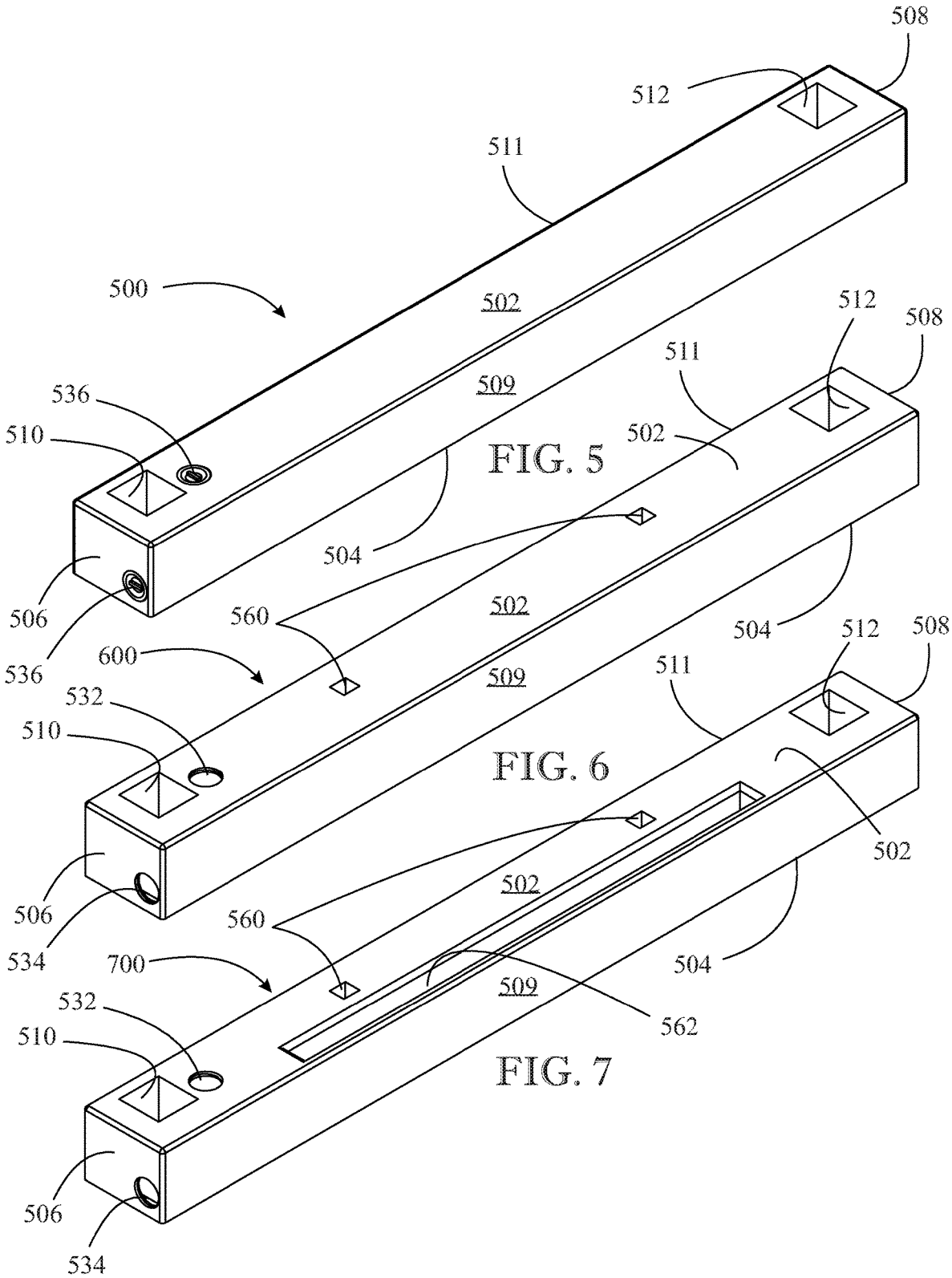
FIG. 5 presents a front-left-top isometric view of the base component for the fence assembly originally introduced in FIG. 1, according to one type of base configuration, illustrating, among other things, how the pair of apertures 532, 534 provided in the base are each equipped with a watertight sealing cap 536.
FIG. 6 presents a front-left-top isometric view of the base component for the fence assembly disclosed in FIGS. 8-15, according to an alternative base configuration implementation.
FIG. 7 presents a front-left-top isometric view of a further alternative configuration for the base component originally introduced in FIG. 6, illustrating a trough 562 provided in the upper surface of the base component to serve as a planter space (Note: The trough 562 is shown in connection with base component 600; however, this structure can just as easily be incorporated into the upper surface 502 of base component 500.

Referring now generally to accompanying FIGS. 1-5, a fence assembly in the form of a modular fence unit is generally shown at 100, according to a first implementation of the present invention. The fence unit 100 includes, in combination, a single fence panel shown generally at 102, a pair of spaced-apart left and right end posts 104, 105, respectively, and a base 500 (FIG. 5).

The fence panel 102 has a frame, shown generally by reference number 110 (FIG. 3) including a pair of spaced-apart left and right end supports 112, 113, respectively, and a pair of spaced-apart upper and lower rails 114, 116, respectively, extending between the pair of end supports 112, 113. The fence panel 102 further includes a set of individual pickets (slats or planks) 120 that extend vertically between the pair of frame rails 114, 116. The pair of end supports 112, 113 has a generally upright or vertical orientation in its lengthwise direction, while the pair of rails 114, 116 has a generally horizontal orientation in its lengthwise direction. The fence panel 102 incorporates a unitary, or one-piece, unit construction.

Each of the end supports 112, 113 has a generally elongated structure. In one form, each end support 112, 113 may incorporate a generally square or rectangular cross-sectional geometry defining, for each end support, an inner side 130 and an opposite outer side 132. The frame rails 114, 116 each extend between the opposing inner sides 130 of the end supports 112, 113. The end supports 112, 113 may be made of any suitable material or construction. For example, the end supports 112, 113 may have a solid or hollow construction. Furthermore, they may be manufactured from, for example, a thermoformed plastic such as polyethylene terephthalate (PET), injection molded Acrylonitrile Butadiene Styrene (ABS), and the like. Likewise, the frame rails 114, 116 may be made of any suitable material or construction. Each one of the frame rails 114, 116 has a generally elongate structure and has a design suitable for supporting the set of pickets 120. The pickets 120 may be arranged in any suitable fashion. For example, although shown in a vertical orientation, the pickets 120 may be arranged in a horizontal fashion (i.e., extending between the pair of end supports 112, 113). Additionally, the pickets 120 can have any relative position to one another, such as spaced-apart or abutting (i.e. no gaps).

Figure 7A:
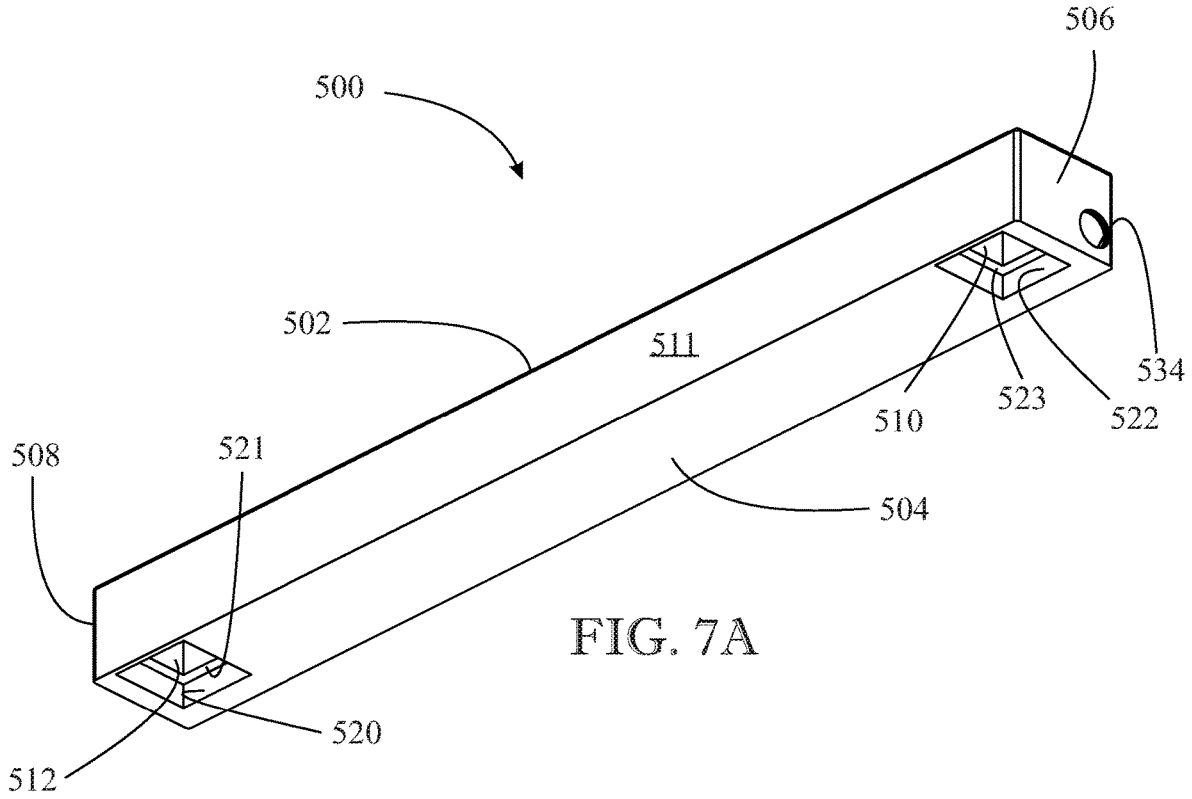
FIG. 7A presents a rear-left-bottom isometric view of the base component originally introduced in FIG. 7, illustrating the pair of through-slots formed at opposite ends of the base component and generally depicting their conforming design to facilitate reception of the end posts into the base in a seated relationship.

Referring now particularly to FIGS. 5 and 7A, the base 500 has a generally elongate structure in the form of a rectangular prism including a pair of opposite upper and lower sides, 502 and 504, respectively, a pair of opposite left and right sides, 506 and 508, respectively, and a pair of opposite front and rear sides, 509 and 511, respectively. The base 500 includes a pair of left and right post-receiving openings, holes, slots, or channels, 510 and 512, respectively, extending fully between the upper and lower sides 502, 504, and disposed at opposite ends of base 500. The post-receiving slots 510, 512 are of sufficient size to receive and seat the pair of left and right end posts, 104 and 105, respectively. In particular, as best shown in FIG. 7A, the right base channel is uniquely configured having a channel configuration incorporating a first depression, or cavity 520 transitioning, via inwardly-stepped shoulder 521, to secondary channel 512 having a reduced cross-sectional area. Likewise, the left base channel is uniquely configured having a channel configuration incorporating a first depression, or cavity 522 transitioning, via inwardly-stepped shoulder 523, to secondary channel 510. In one form, the pair of post-receiving slots 510, 512 each have a square cross-sectional profile to accommodate the pair of end posts 104, 105, which are threaded, maneuvered, or otherwise inserted topside 138 first through the pair of post-receiving slots 510, 512, respectively, from the underside 504 of base 500, as part of the assembly process. Alternatively stated, the base 500 may be lowered downwardly (i.e. base lower side 504 first) toward a pair of spaced-apart, upright end posts 104, 105 to enable the end posts to be slidably received through concentric left channel 510 and depression 522, and concentric right channel 512 and corresponding depression 520, such that, when fully seated, the pedestal 140 at the lower end of each end post 104, 105 is snugly received within its corresponding depression 520, 522, and the sides 134, 136, 137, 139 of each end post are snugly received within the corresponding base channels 510, 512. As used herein, the term "concentric" is meant to denote that right side depression 520 and right channel 512 (and left side depression 522 and left channel 510) share a common central axis. Furthermore, as used herein, the term "snugly" is meant to denote that the exterior geometry of each pedestal 140 substantially conforms to the corresponding geometry of each depression 520, 522, while the exterior geometry of each end post above the pedestal 140 substantially conforms to the corresponding geometry of each channel 510, 512. Accordingly, when fully assembled, sides 142 of pedestal 140 abut the corresponding sidewalls 520 defining the square depressions, and the pedestal shoulder 141 abuts the corresponding depression shoulder 521. As will be apparent to those skilled in the art, although the preferred implementation of the invention incorporates end posts 104, 105 having a square cross-sectional geometry the invention is not intended to be so limited. The end posts 104, 105 (as well as the corresponding pedestals 140) could be constructed to have virtually any cross-sectional geometry, including, for example, circular, elliptical, and any polyhedron.

Each end post 104, 105 is equipped with a pedestal 140 integral with the main body of each end post 104, 105 and extending vertically upward therefrom. Significantly, each pedestal 140 has a footprint that is larger than the cross-section of each corresponding end post main body, promoting stability once the assembled fence unit 100 is deployed for use in the field. The pedestal 140 also conforms to the cavities 520, 522 defining shoulders 521, 523 (see FIG. 7A), such that engagement of the pedestal shoulders 141 and pedestal sidewalls 142 with the corresponding cavity shoulders 521, 523 and cavity sidewalls 520, 522 prevents the respective right and left end posts 104, 105 from being pulled upwardly beyond their desired height. Referring primarily to FIG. 7A, as described above, the widened lower openings 520, 522 of the pair of post-receiving channels 510, 512, or slots, of base 500 has a geometry—or profile/design—that conforms to the exterior surface, or geometry/shape, of the pedestal 140 of each of the end posts 104, 105. For example, if the pedestal 140 has a beveled or sloping design, the lower surface 520 of post-receiving slots 510, 512 will have a matching and complementary profile. The conforming shape of lower opening/cavities 520, 522 of channels/slots 510, 512 serves to define respective shoulders 521, 523 against which the corresponding shoulders 141 of pedestals 140 bear upon, as each end post 104, 105 is fully inserted upwards through the respective pair of post-receiving slots 510, 512 from the underside of base 500. This seating relationship is best shown in the cross-sectional view of FIG. 12. Once pedestal 140 is seated within its corresponding post-receiving slot 510, 512, the bottom surface of pedestal 140 sits flush with the lower surface, or side 504, of base 500; thereby, creating a substantially uniform and planar surface to rest on the ground or other surface where the fence unit 100 is installed. In this manner, the base structures 500, 600, 700 impart excellent stability to the end posts 104, 105 when fully assembled. Other shoulder designs are possible with pedestal 140, such as, for example, a tapered/sloped shoulder, or an inwardly-stepped or staircase feature. Generally, the end posts 104, 105 are each provided with a pedestal 140 provided at a lower end of a respective one of the end posts 104, 105. Preferably, the pedestals 140 are integral with the main bodies of the respective end posts 104, 105 to form a unitary end post structure. Additionally, pedestal-receiving cavities and contiguous end post main body receiving channels are provided configured at a lower end of a respective one of the post-receiving slots 510, 512 defined in the base 500, each conforming to a respective one of the pair of end post pedestals 140.

Each of the end posts 104, 105 is releasably attachable to fence panel 102 at the corresponding end supports 112, 113 via a mating-type joint relationship. In particular, according to one illustrative form, a tongue-and-groove combination is employed to fit or otherwise join the pair of end posts 104, 105 to the pair of end supports 112, 113 of fence panel 102. For this purpose, with particular reference to FIG. 3, each one of the end supports 112, 113 of fence panel 102 includes a male portion or tongue 150 provided extending outwardly from outer side 132. The tongue 150 extends generally vertically, or longitudinally, in a lengthwise direction along end supports 112 and 113, and preferably spans along all (or substantially all) of this dimension. The male portion 150 can be provided in a variety of conventional forms, such as T-shaped or a sliding dovetail joint, by way of example. Each one of the end posts 104, 105 has an inner, or inner-facing, side 134 and an opposite outer, or outer-facing, side 136. The inner sides 134 of the respective end posts 104, 105 are disposed in facing opposition to the outer side 132 of end supports 112, 113 of fence panel 102. The inner side 134 of end posts 104, 105 is provided having a female portion, or groove, that is complementary and slidably mateable with tongue 150. The groove 160 extends generally vertically in the lengthwise direction of end posts 104, 105, and spans the entire, or substantially all of, the end post length. In a broader sense, the tongue-and-groove combination 150, 160 is representative of any suitable type of fitting arrangement capable of providing a sliding joint.

Figure 1:
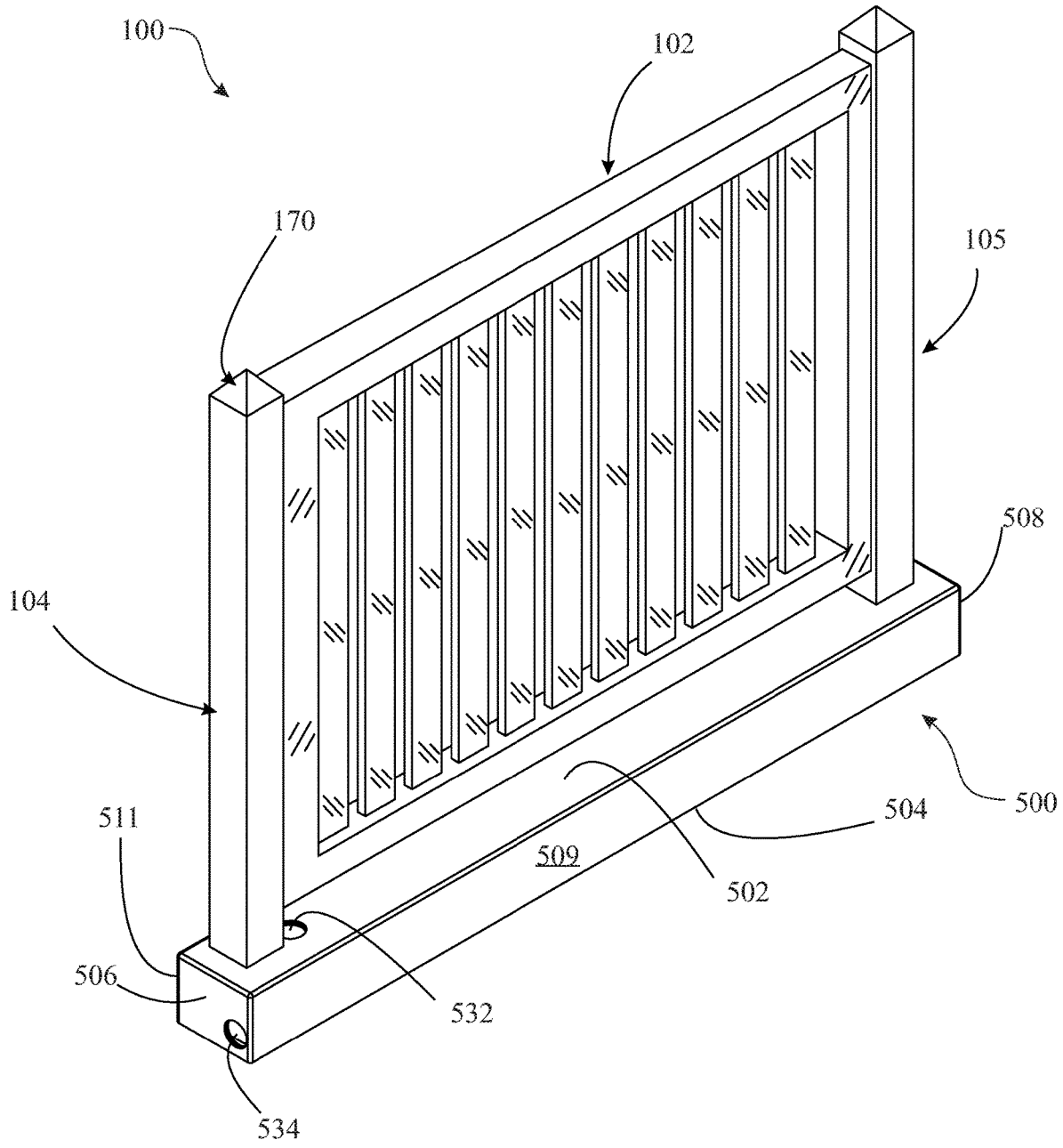
FIG. 1 presents a front-left-top isometric view of a fence assembly in its fully assembled configuration, according to a first implementation of the present invention.
Figure 2:
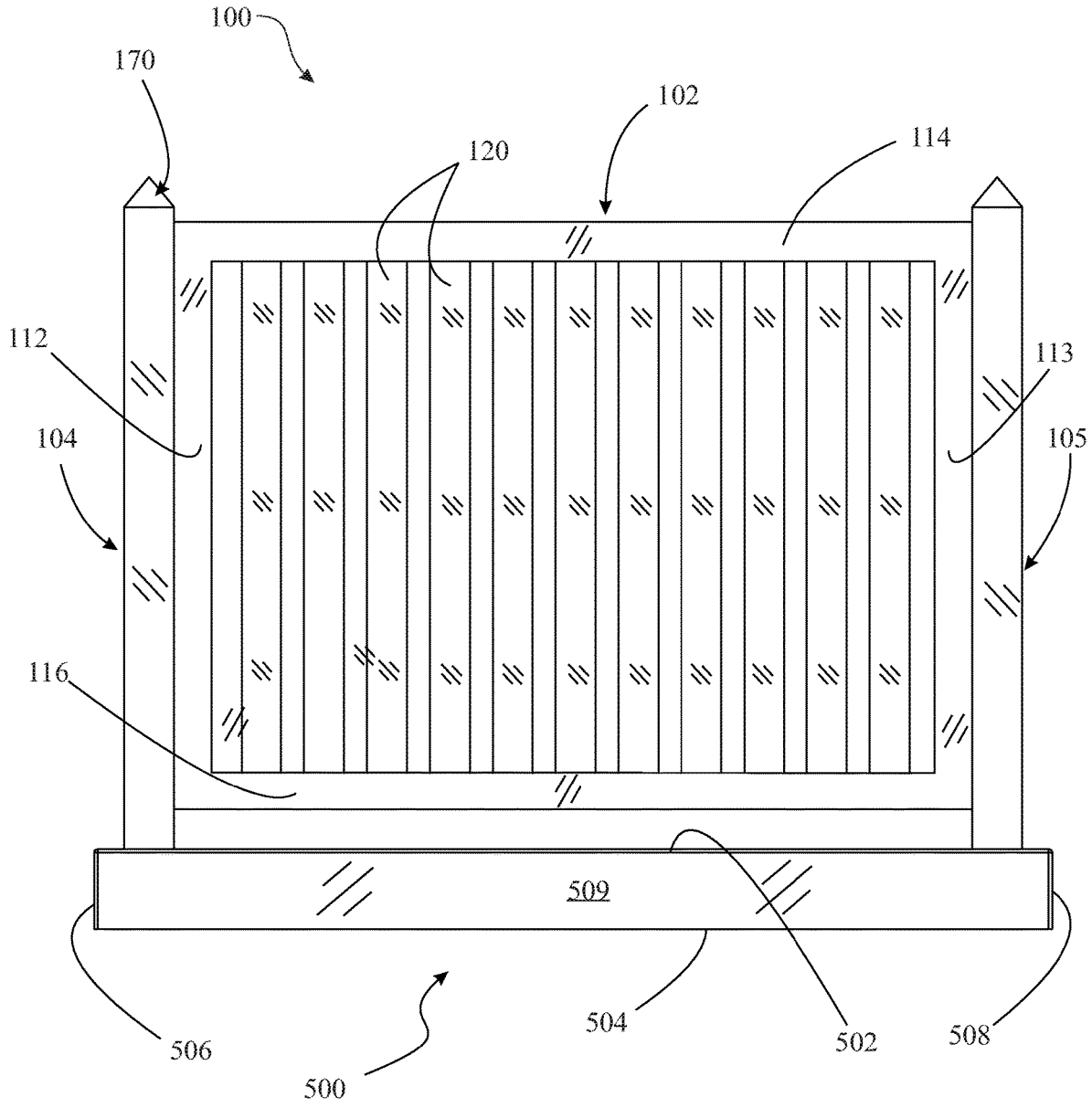
FIG. 2 presents a front elevation view of the fence assembly originally introduced in FIG. 1.

During assembly, after base 500 is seated on end posts 104, 105, the fence panel 102 is maneuvered into position so that the tongue 150 of end supports 112, 113 of fence panel 102 are aligned from above in registration with the corresponding grooves 160 of end posts 104, 105. The tongue 150 is subsequently slidably inserted, or received, within groove 160 at both sides of fence panel 102. As tongue 150 continues its guided, downward displacement or sliding action through groove 160 at both sides of fence panel 102, the fence panel 102 acquires its final assembled resting place as shown in FIGS. 1 and 2, once the extent of travel is reached and fence panel 102 slides into its assembled position. The fence panel 102 can be removed from its installed releasable attachment to the pair of end posts 104, 105 by simply lifting up fence panel 102 in the vertical direction in a sliding motion, such that the tongues 150 are gradually backed out of their location within the respective grooves 160.

The tongue-and-groove combination provided by tongue 150 (at the pair of frame end supports 112, 113) and groove 160 (at the pair of end posts 104, 105) is representative of a type of joint suitable to promote just a single degree of freedom between fence panel 102 and the pair of end posts 104, 105; namely, an up-and-down sliding-type relative motion. Otherwise, the fence panel 102 is restricted from motion in other directions by the joint design. In particular, the joint created by the tongue-and-groove combination provides a coupling relationship involving an interlocking, fastener-type, retention fit that offers a single degree of freedom (i.e., a relative sliding motion between the parts). The tongue 150 is firmly held in place in groove 160, but is permitted relative sliding motion. The tongue-and-groove combination can be reversed, such that the male portion (tongue) is located on the pair of end posts 104, 105, while the female portion (groove) is located on the pair of frame end supports 112, 113, without departing from the intended scope of the invention.

One particular form of the joint configuration incorporates a sliding dovetail joint including a female socket portion and a male tail portion. The female socket portion is defined at the inner surface 134 of the associated end post 104, 105, and the male tail portion is defined at the opposing outer surface 132 of the associated frame end support 112, 113. The male tail portion is releasably slidingly receivable within the female socket portion.

Overall, the assembled relationship among the various parts of fence unit 100 features no fixed, permanently-secured relationship between the parts (i.e., fence panel 102, base 500, and pair of end posts 104, 105). These parts are fitted together without the need for any fastening hardware, such as screws, nails, or bolts. Significantly, in this manner, the components of fence unit 100 can be collectively considered a kit that requires no tools to assemble or disassemble. The action required to assemble and disassemble fence unit 100 simply involves relative sliding movement between the parts.

Referring primarily to FIGS. 1, 3, 4 and 12, fence unit 100 includes, in one form, an interior fluid compartment space 530 (FIG. 12) defined by hollow base 500. This interior space 530 is configured to receive and retain a volume of fluid—such as water. For this purpose, base 500 is designed with a hollow interior form to define fluid compartment space 530. Base 500 includes, in one form, a pair (or more) of apertures 532, 534 (FIG. 1) that are disposed in fluid communication with the interior fluid compartment space 530. For example, aperture 532 extending through the upper side 502 of base 500 serves as a fill port through which fluid may be received into the interior fluid compartment space 530. Additionally, lateral aperture 534 (i.e., extending through respective base ends 506 and/or 508) may serve as a drain port through which fluid contained in compartment space 530 may be discharged. The water-fillable feature of base 500 functions in part to add ballast, such as water, to fence unit 100 to help it remain anchored and stable when placed in its working position on a resting surface. In conventional manner, the apertures 532, 534 in base 500 may be suitably fitted with respective removable sealing caps or sealing screws 536 (FIG. 5).

Referring again to FIGS. 1 and 3, the pair of end posts 104, 105 may be equipped with a pair of threaded caps 170 having a decorative/ornamental top 172 (e.g., square pyramidal form) and a threaded portion 174 mounted underneath. After assembly of fence unit 100, the pair of threaded caps 170 may be threaded into threaded recesses 176 formed in the top side of end posts 104, 105. In this manner, the threaded caps 170 help secure the tongue-and-groove joint in place. In particular, the threaded caps 170 are adapted to at least cover the upper end of groove 160, keeping the tongue 150 resting therein held in place.

Figure 8:
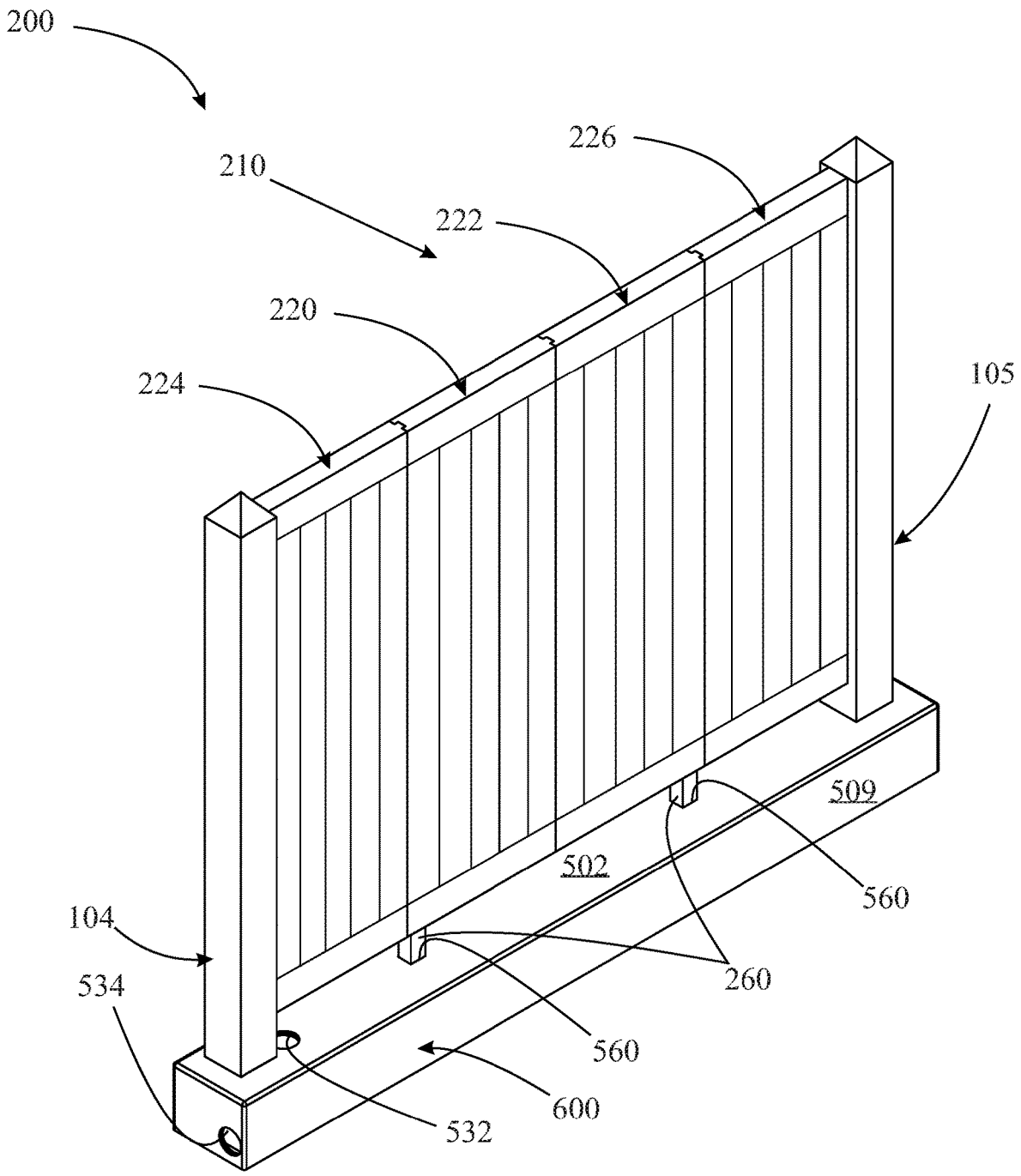
FIG. 8 presents a front-left-top isometric view of a fence assembly in its fully assembled configuration, according to a second implementation of the present invention, and employing a base configuration incorporating the base component 600 of FIG. 6.
Figure 9:
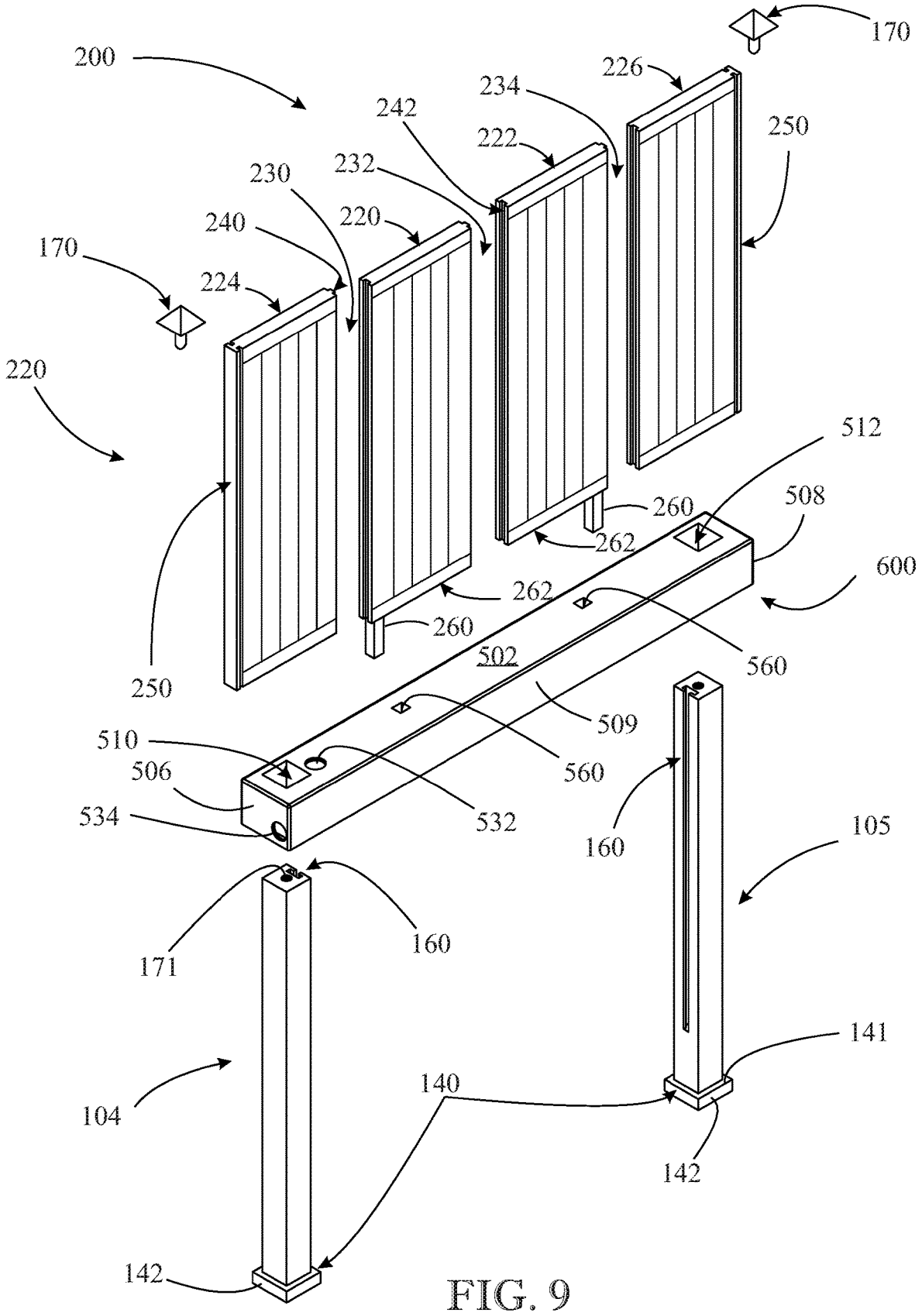
FIG. 9 presents an exploded, front-left-top isometric view of the fence assembly originally introduced in FIG. 8.
Figure 10:
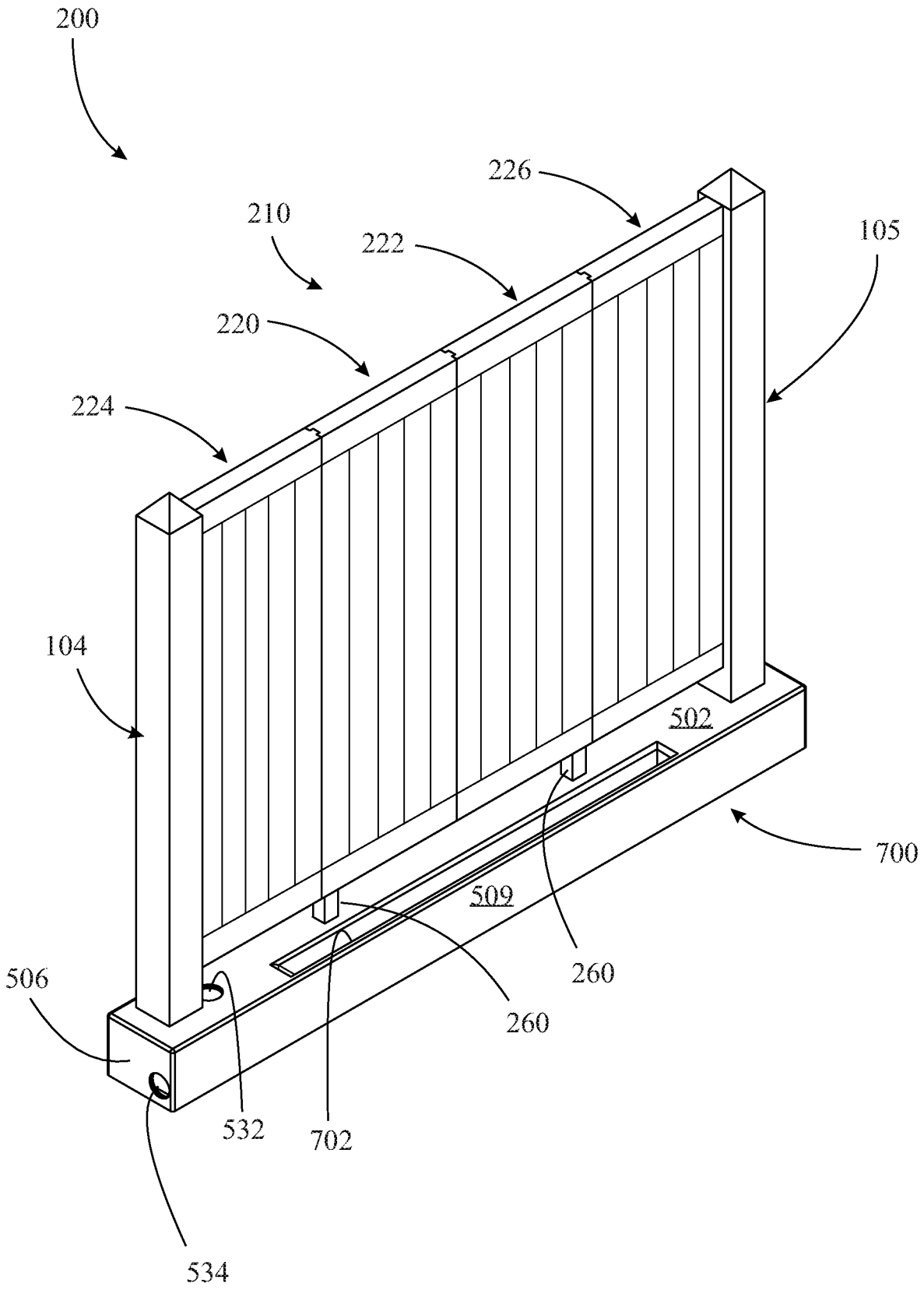
FIG. 10 presents a front-left-top isometric view of the fence assembly originally introduced in FIG. 8, but modified to incorporate the alternative base configuration 700 originally introduced in FIG. 7.
Figure 11:
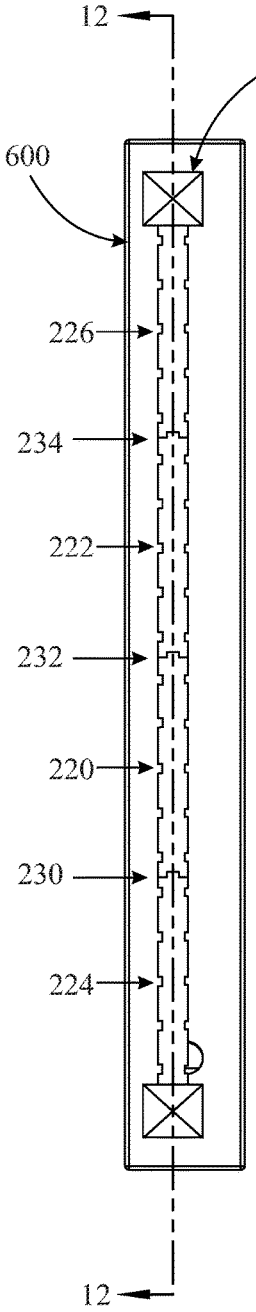
FIG. 11 presents a top plan view of the fence assembly originally introduced in FIG. 8, illustrating the interlocking, side-by-side arrangement of the picket panels 220, 222, 224, 226.

Referring now to FIGS. 8-15, with initial reference to FIGS. 8-9, a fence assembly in the form of a modular, multi-panel fence unit is generally shown at 200, according to a second implementation of the present invention. FIGS. 1-4, by comparison, depict a single panel embodiment. The fence unit 200 includes, in combination, a panel group generally illustrated at 210 including a set of individual vertically-oriented panels arranged row-wise and serially in abutting, side-by-side adjacent fashion. The panel group 210 includes a first subgroup of inner panels 220, 222 and a second subgroup of outer panels 224, 226. Each of the outer panels 224, 226 serves as an end panel such that, together, the bracket, or bookend, the pair of inner panels 220, 222. Although the first subgroup illustrates a pair of inner panels 220, 222, this is for illustrative purposes only, as multi-panel fence unit 200 can be extended to include any suitable number of inner panels depending on the desired size of the individual fence unit 200. The fence unit 200 further includes, in combination, a pair of spaced-apart left and right end posts 104, 105 similar to those in FIGS. 1-4; and, a base 600 (FIG. 6).

The individual panels of panel group 210 may be of uniform or variable size. The individual panels of panel group 210 are each arranged in abutting side-to-side relationship with any adjacent panels, thereby forming a composite fence barrier having no inter-panel gaps. In order to facilitate this abutting relationship, fence unit 200 includes a set of joint configurations of a first type each disposed at a respective interface generally illustrated at 230, 232, 234 between adjacent pairs of panels, 224/220, 220/222, and 222/226, respectively. Each such joint configuration has a similar construction and includes a tongue-and-groove combination, for example, that allows adjacent panels to fit together in some kind of joint that holds the adjacent panels together and maintains them in a stable side-to-side orientation. It is not necessary for the joint to have an interlocking feature limiting movement to just one degree of freedom, e.g., relative sliding motion. In a preferred form, the tongue-and-groove combination is suitably adapted to support relative sliding motion between the adjacent panels to facilitate assembly. An illustrative tongue-and-groove joint configuration is generally illustrated at inter-panel interface 230 by a male portion or tongue 240 on one side of panel 224 (facing adjacent panel 220) and a mateable and complementary female portion or groove 242 on an opposing side of adjacent panel 220. A similar tongue-and-groove joint configuration is present at each of the other inter-panel interfaces 232, 234.

Figure 3:
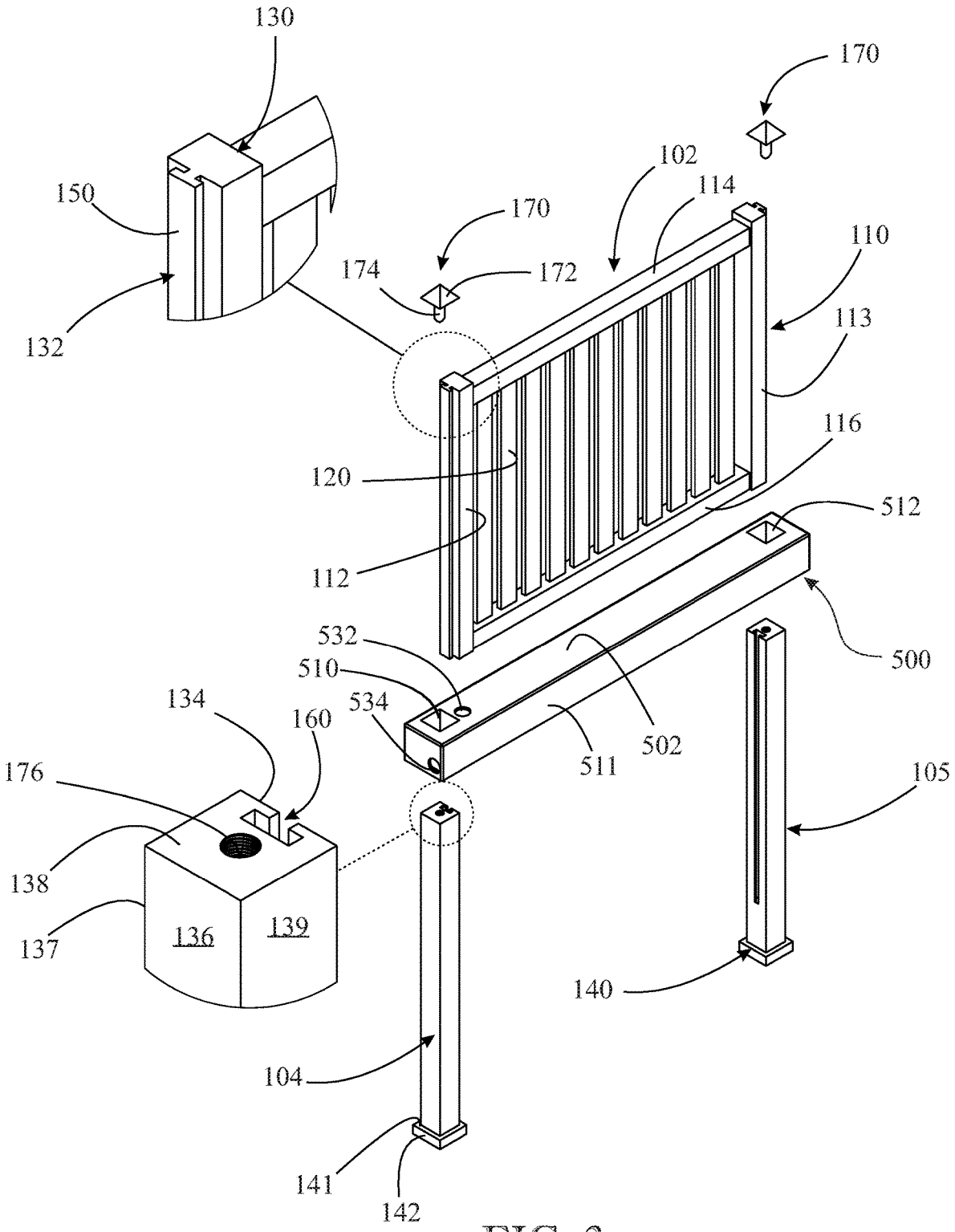
FIG. 3 presents an exploded, front-left-top isometric view of the fence assembly originally introduced in FIG. 1, illustrating in an enlarged sectional view showing how the unitary picket frame panel is attached to the end posts in a male-female mating arrangement.
Figure 4:
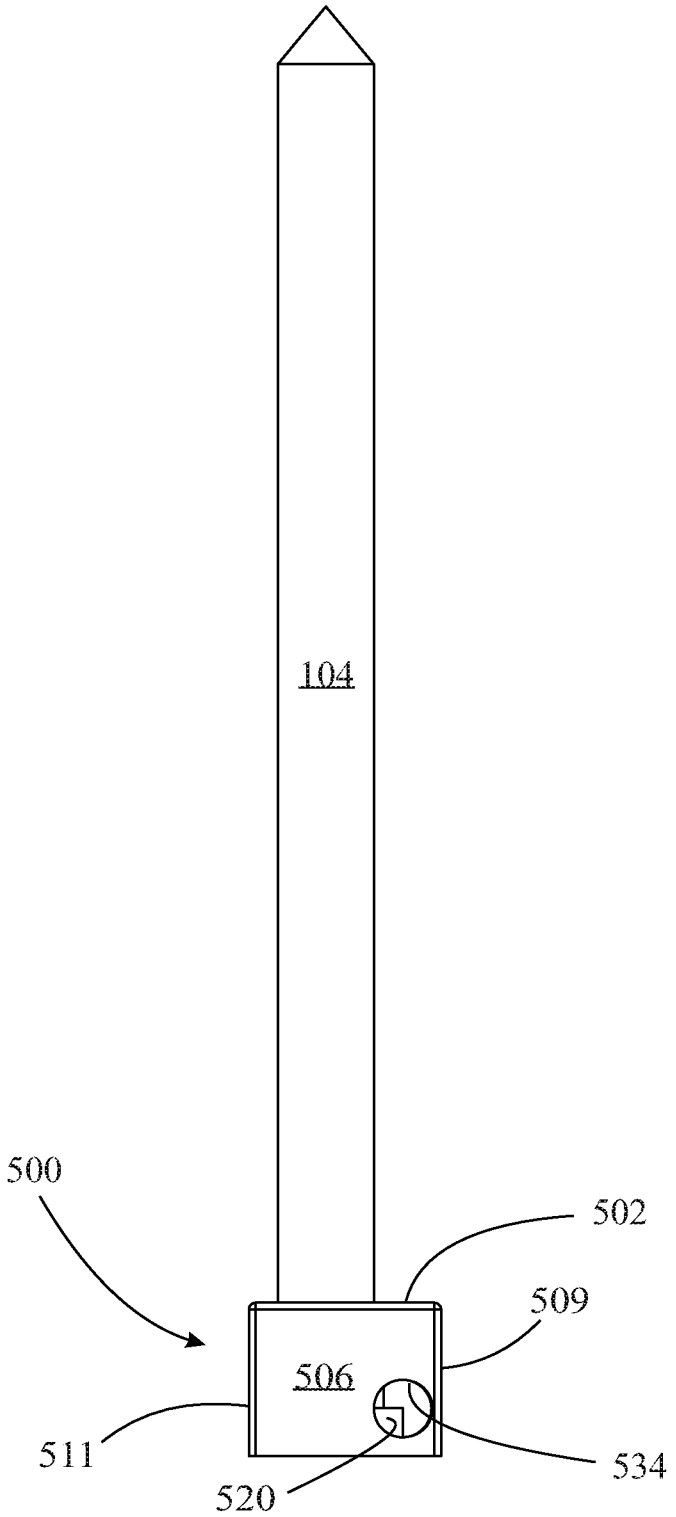
FIG. 4 presents a left end elevation view of the fence assembly originally introduced in FIG. 1, illustrating, among other things, one of the apertures (i.e. the water outlet aperture 534) provided in the base 500 of the fence assembly 100.

The fence unit 200 also includes a pair of joint configurations of a second type that function to join together, in a secure mating relationship, the pair of end posts 104, 105 and the pair of outer end panels 224, 226 of panel group 210. For this purpose, the joint configuration is similar to that employed by fence unit 100 (FIGS. 1-5), with regard to the coupling relationship between the pair of end posts 104, 105 and the pair of end supports 112, 113 (FIG. 3). Referring to FIG. 9, corresponding tongue and groove structures are located at opposite ends of fence unit 200; namely, at the interface between left end post 104 and left-end panel 224, and at the interface between right-end post 105 and right end panel 226. An illustrative tongue-and-groove joint configuration is generally illustrated by male portion or tongue 250 (similar to tongue 150 in FIG. 3) disposed at an outer-facing side of left outer end panel 224, and complementary female portion or groove 160 formed at an inner-facing side of left end post 104. Like the counterpart arrangement in FIGS. 1-4, the tongue-and-groove combination in FIGS. 8-15 (deployed between the pair of end posts 104, 105 and the pair of outer end panels 224, 226) is configured to restrict the relative movement between tongue 250 and groove 160 to that of a relative sliding motion.

Figure 12:
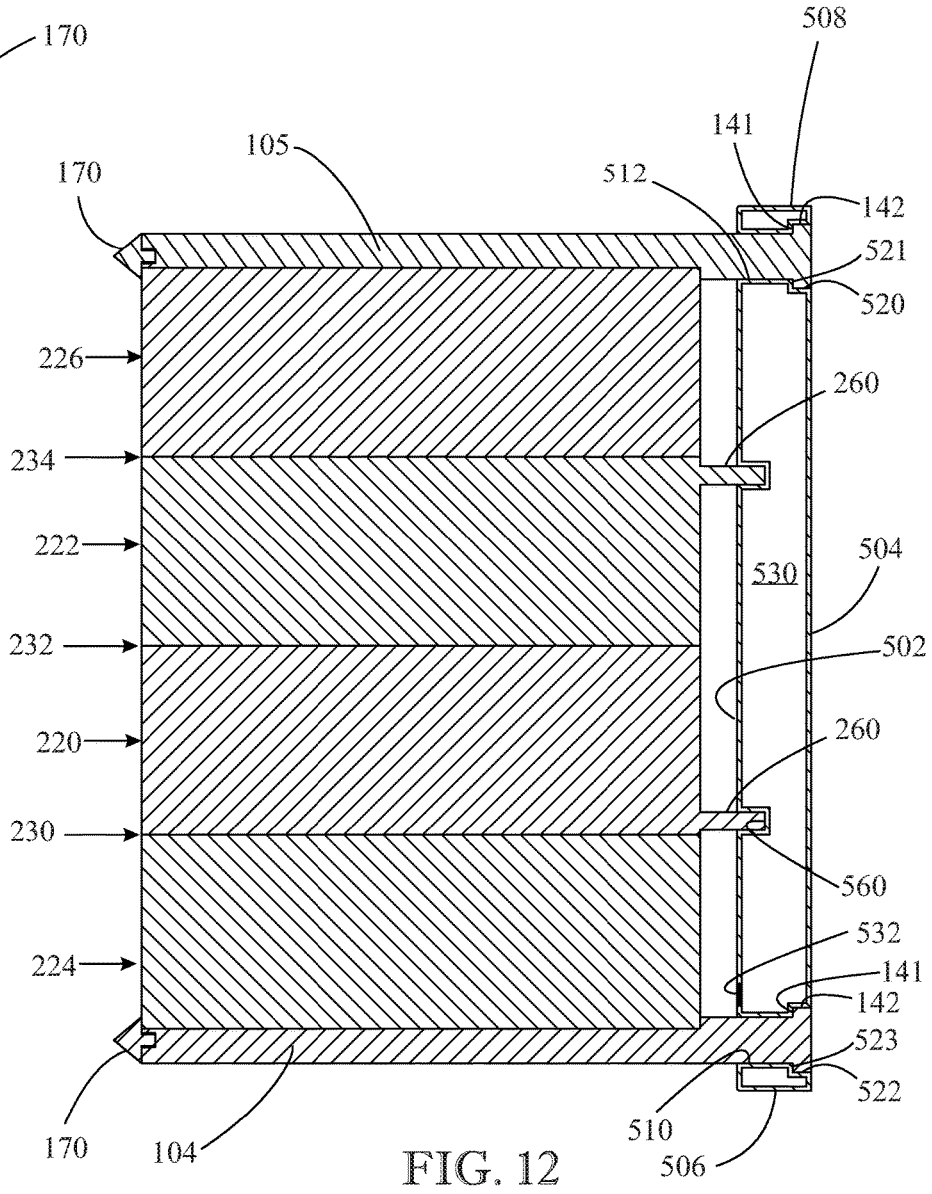
FIG. 12 presents a cross-sectional, front side view of the fence assembly originally introduced in FIG. 8, taken along section lines 12-12 in FIG. 11, illustrating how the end posts are received within a complementary formation in the base and how the inner set of picket panels are located in corresponding registration cavities formed in the upper part of the base.
Figure 13:
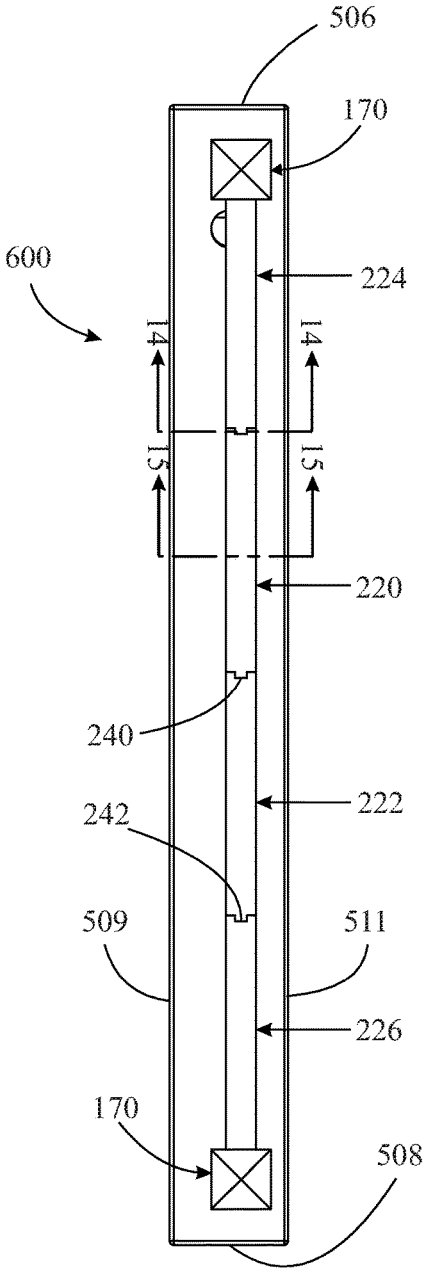
FIG. 13 presents a top plan view of the fence assembly originally introduced in FIG. 8.
Figure 14:
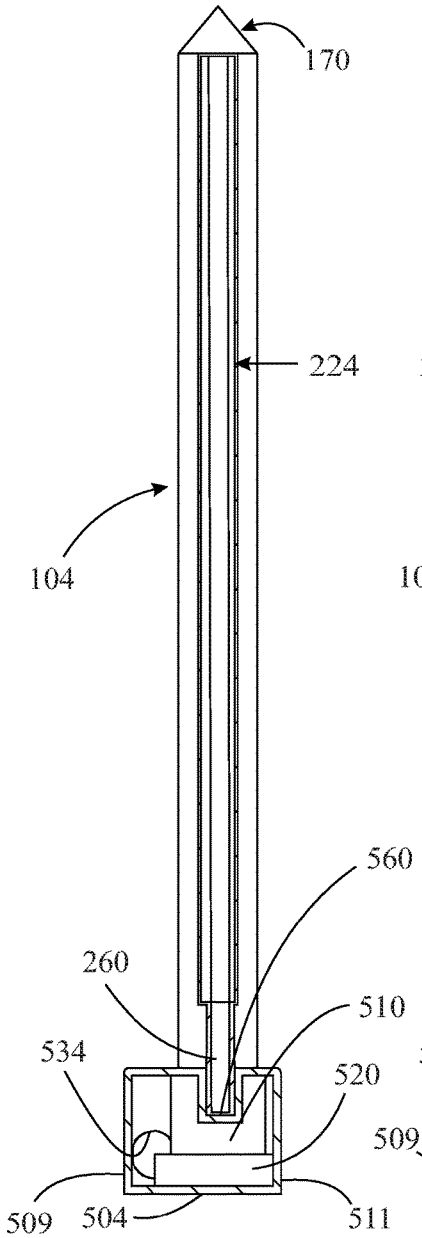
FIG. 14 presents a cross-sectional, end-facing view of the fence assembly originally introduced in FIG. 8, taken along section lines 14-14 in FIG. 13, illustrating how the downwardly depending projection leg of one of the inner picket panels is seated within a corresponding location cavity formed in the base.
Figure 15:
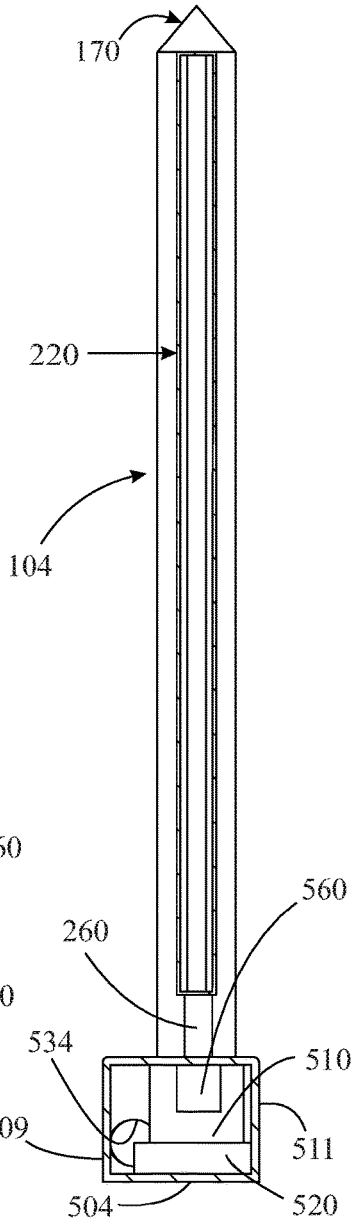
FIG. 15 presents a cross-sectional end view of the fence assembly originally introduced in FIG. 8, taken along section lines 15-15 in FIG. 13, illustrating the relationship of the projection leg of one of the inner picket panels to its corresponding location cavity formed in the base, taken from the perspective of a mid-line plane through the picket panel.

Referring still to FIGS. 8-15, each one of the inner panels 220, 222 is preferably provided with a locating pin, leg, boss, or projection 260 that depends downwardly and extends in a generally vertical direction from a lower side 262 of each inner panel 220, 222. Each locating pin 260 is associated with a respective corresponding cavity, aperture, or pin-receiving pocket 560 formed in the upper side of base 600 (e.g., during a plastic molding operation), so that locating pin 260 can fit securely and rigidly into pocket 560, i.e., locating pin 260 cannot move within pocket 260 other than a relative vertical sliding motion upon insert or withdrawal. The pair of pockets 560 formed in the upper side of base 600 serve as registration marks that help align the inner panels 220, 222 with base 600. In particular, during assembly, the inner panels 220, 222 are situated and positioned over base 600 so that the locating pins 260 are in alignment with their corresponding pin-receiving pockets 560. Once the locating pins 260 are slidably-received within the respective pin-receiving pockets 560, this condition represents the final assembled position of the inner panels 220, 222 (FIGS. 12, 14). In this installed position, the rigid fit between the locating pins 260 and the pin-receiving pockets 560 maintains the inner panels 220, 222 in a stable, stationary arrangement relative to base 600. The tongue-and-groove fit between the adjacent inner panels, in combination with the use of the locating pins 260 to firmly fix the inner panel in place, offer a very stable support. The tongue-and-groove joint between the adjacent inner panels maintains a firm side-by-side orientation between the panels, while the registration of the locating pins 260 in pin-receiving holes 560 fixes the orientation of the inner panel to base 600. The locating pins 260 can be situated at any place along the bottom side of the respective inner panel.

During assembly of the modular multi-panel fence unit 200, the pair of end posts 104, 105 is inserted through the corresponding pair of post-receiving slots 510, 512 formed in base 600 from the underside of base 600. Once the pair of end posts 104, 105 is appropriately seated in base 600, the panel group 210 can be installed. The sequence of installation for the panels can be arbitrary. For example, the set of inner panels 220, 222 can be installed first by inserting their locating pins 260 in the respective pin-receiving cavities 560 formed at the top side of base 600, while simultaneously joining the adjacent panels 224, 226 at the tongue-and-groove combination 240, 242 defined at their interface 230. Next, the pair of outer panels 224, 226 is installed by sliding them into place. In particular, tongue 250 of outer panel 224 is slidingly and matingly received within corresponding groove 160 formed in end post 104, completing the installation.

The fence unit 200 disclosed in FIGS. 8-15 can alternatively utilize the base 700 shown in FIG. 7 (FIG. 10), which incorporates a basin or trough-like receptacle 702 provided in the upper side of base 700. The receptacle 702 may be suitable as a space for planting flowers and the like (i.e. functioning as a planter). Regarding the various base designs shown in FIGS. 5-7, the base 600 (FIG. 6) is similar to base 500 (FIG. 5) but modified to incorporate the set of pin-receiving cavities 264 formed at the upper side of base 600. Moreover, base 700 (FIG. 7) is similar to base 600 but modified to incorporate the trough receptacle 702. All of the base designs, for example, preferably have an interior fluid-receiving and storing compartment space 530 (FIG. 12).

Figure 16:
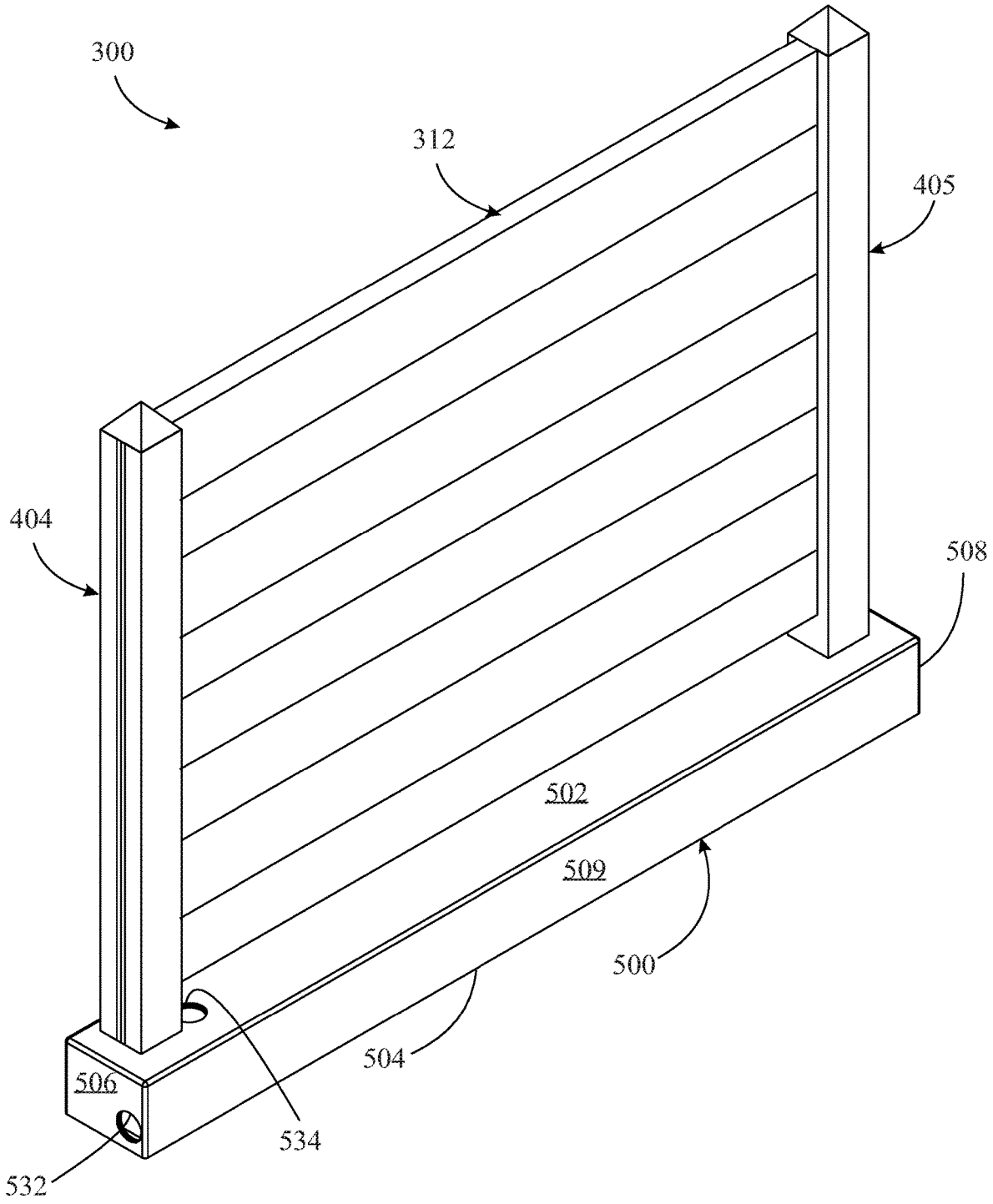
FIG. 16 presents a front-left-top isometric view of a fence assembly in its fully assembled configuration, according to a third implementation of the present invention.
Figure 17:
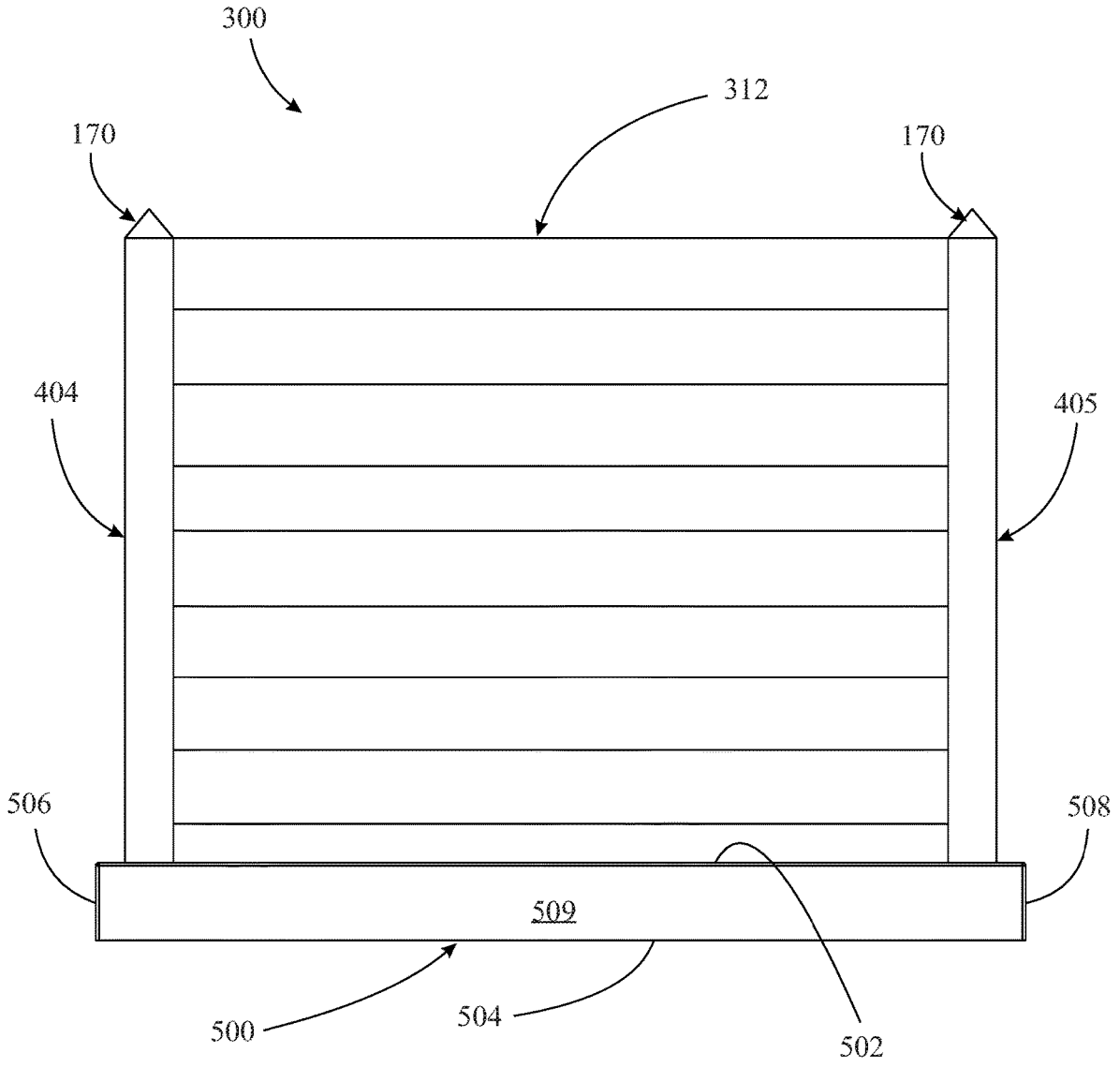
FIG. 17 presents a front elevation view of the fence assembly originally introduced in FIG. 16.
Figure 18:
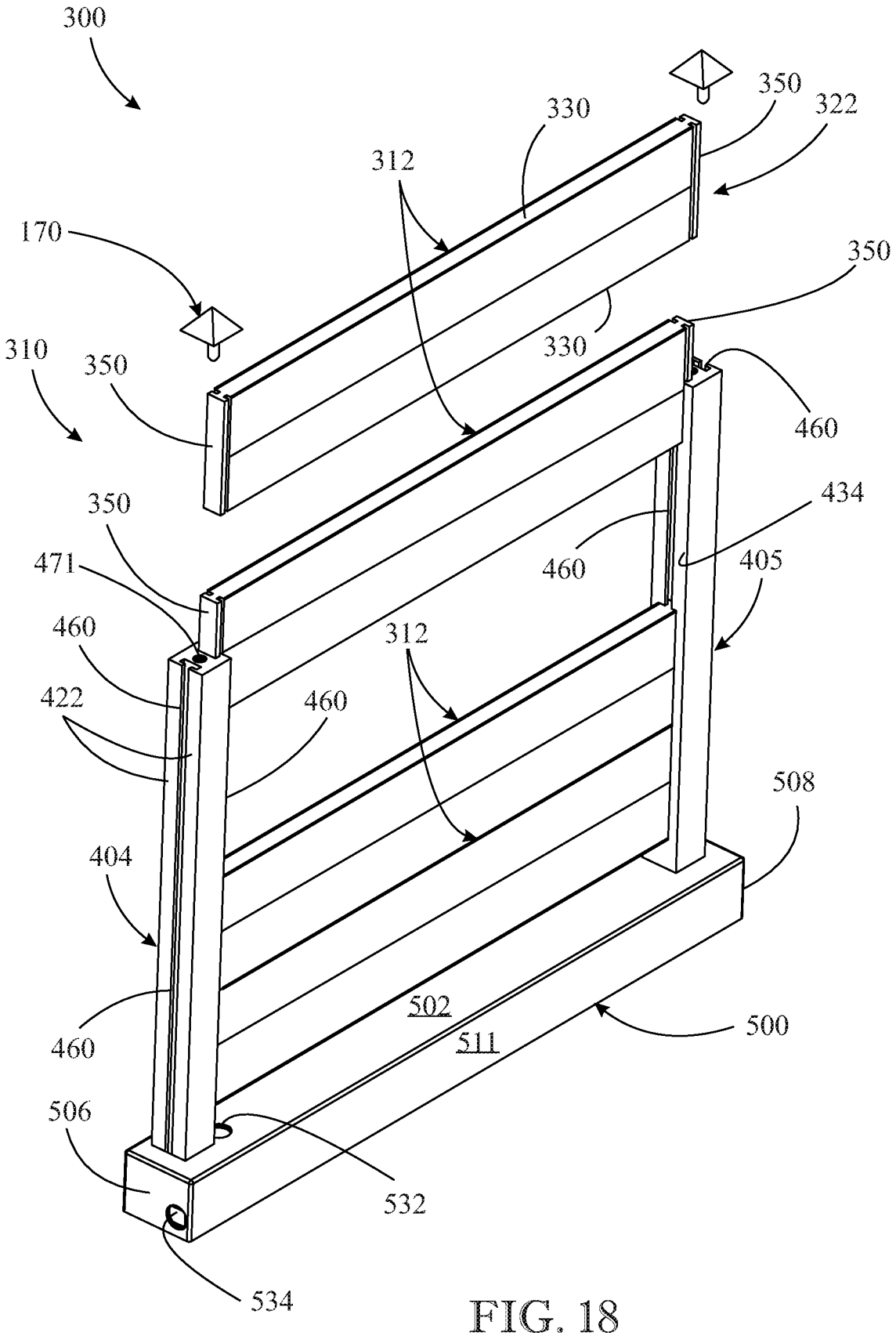
FIG. 18 presents a front-left-top isometric view of the fence assembly originally introduced in FIG. 16, showing the fence assembly in an intermediate state of assembly, with one horizontal panel fully removed from its installed location, one horizontal panel partially installed, and a pair of horizontal panels fully installed in their stacked arrangement.

Referring now to FIGS. 16-18, a fence assembly in the form of a modular, multi-panel fence unit is generally shown at 300, according to a third implementation of the present invention. The fence unit 300 includes, in combination, a panel group generally illustrated at 310 including a set of individual horizontally-oriented panels 312 arranged in column-wise fashion to form a vertical stacking arrangement, where adjacent panels 312 abut one another. The fence unit 300 further includes, in combination, a pair of spaced-apart left and right end posts 404, 405 similar to the end posts 104, 105 in FIGS. 1-4; and, a base 500 (FIG. 5).

The set of panels 312 extend between the pair of end posts 404, 405 in a horizontal orientation. For this purpose, each panel 312 is appropriately fitted at both ends to mateably engage both posts 404, 405, in a manner that permits relative sliding motion between the panel 312 and the pair of posts 104, 105. In one form, the joint configuration between panel 312 and the pair of posts 404, 405 employs a fitting such as a tongue-and-groove combination. In particular, at each end 322 of panel 312 opposite the pair of posts 404, 405, a male portion or tongue 350 extends vertically along the opposite ends 322 of panel 312. As a counterpart to tongue 350, each end post 404, 405 includes a complementary and mateable female portion or groove 460 formed at an inner side 434 facing opposite the end side 322 of panel 312 where tongue 350 is located. The tongue 350 of fence panel 312 is slidingly and mateably receivable within groove 460 of posts 404, 405. In an alternative configuration, the male and female features can be switched, so that the male fitting is located on the posts 404, 405, and the female fitting is located on the fence panels 312.

During assembly, the pair of end posts 404, 405 is integrated with base 500 in a manner similar to the prior implementations. Each panel 312 is then maneuvered into place between the pair of end posts 404, 405 by aligning tongue 350 at its pair of end sides 322 with the groove 460 formed in posts 404, 405. The panel 312 is then positioned into place as the vertically-oriented tongue portions 350 running along opposite sides of panel 312 may be slidably inserted into corresponding grooves 460 running lengthwise along inner sides 434 of the posts 404, 405. Each subsequent panel 312 is installed atop the prior panel 312 to form a column-type, vertical stacking arrangement. The relationship between adjacent panels 312 is such that the lateral sides 330 abut one another in a flush arrangement, avoiding any gaps between them. The joint configuration between the individual panel 312 and the pair of end posts 404, 405 preferably employs a type of interlocking, fastening feature that supports a single degree of freedom, i.e., relative motion between tongue 350 and groove 460 is limited to a relative sliding motion.

Figure 19:
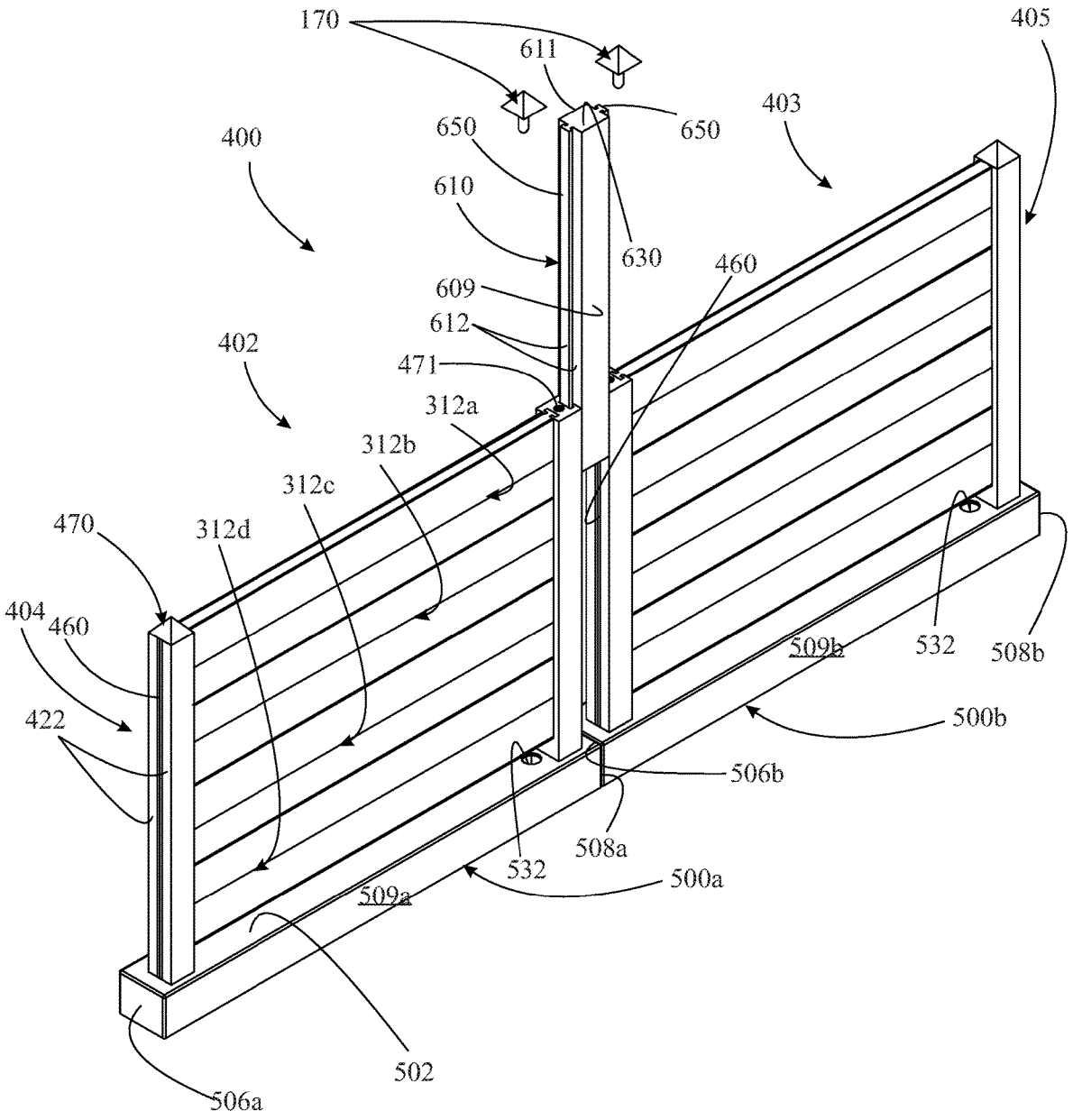
FIG. 19 presents a front-left-top isometric view of a fence combination illustrating the use of a connector post 610, shown in a partially installed condition, to attach a pair of individual fence modular units 300 in adjacent end-to-end fashion adjoined by the connector post, employing fence assembly constructions directed to any of the implementations of the present invention disclosed in FIGS. 1-18.

Referring now to FIG. 19, a fence topology or architecture generally illustrated at 400 shows how adjacent fence units 402, 403 can be connected end-to-end with an intermediate connector post 610, according to another feature of the present invention. Although FIG. 19 deploys the fence unit of FIGS. 16-18 as the fence units 402, 403, this is for illustrative purposes only as any of the fence unit designs disclosed herein can be connected together according to the features disclosed in FIG. 19. In FIG. 19, the individual panels 312 are labeled 312*a* through 312*d* for clarity.

A joint configuration, such as a tongue-and-groove combination, is used to releasably attach the connector post 610 to adjacent fence units 402, 403. For example, connector post 610 is fitted at both connection sides opposite end posts 404, 405 of adjacent fence units 402, 403 with a male portion or tongue 650 that extends vertically along the length of connector post 610. As a counterpart to tongue 650, each end post 404, 405 of adjacent fence units 402, 403 includes a complementary and mateable female portion or groove 460 (FIG. 18) provided (e.g. formed during a molding operation) at an outer side facing opposite the side 612 of connector post 610 where tongue 650 is located. At both connection sides of connector post 610, tongue 650 is slidably and matingly insertable within grooves 460 of posts 404, 405, thereby connecting adjacent posts. In an alternative configuration, the male and female features can be switched, so that the male fitting is located on the posts 404, 405, and the female fitting is located on the connection post 610. The fencing architecture shown in FIG. 19 can be extended to include any number of interconnected fence units using the appropriate number of connector posts 610.

Each one of the fence unit implementations disclosed above provides a modular structure having ease of assembly and disassembly. Each fence unit can be disassembled using a process that is simply the reverse of the procedure used to assemble the fence unit. The end posts will preferably have a uniform, standard design across the implementations, making it easier to offer different versions of the fence units without customizing the end posts. Each base design preferably incorporates, as a standard working structure, a unitary molded plastic construction having a set of apertures (top side and end locations, for example) disposed in fluid communication with an interior fluid compartment. The water-fillable aspect of each fence unit (as a preferable design feature) promotes stability because it offers a ballast located in the lowest portion of the fence unit (i.e., in the base). Significantly, when filled with water the weight of a base 500, 600, and 700 having a preferred size will have a weight approaching 300 lbs. As a result, the water-fillable bases function to provide excellent stability even under windy weather conditions. Furthermore, the water-fillable, portable, modular privacy fence assembly of the present invention incorporates a unique structure that can be easily and efficiently assembled or disassembled at a moment's notice.

Figure 20:
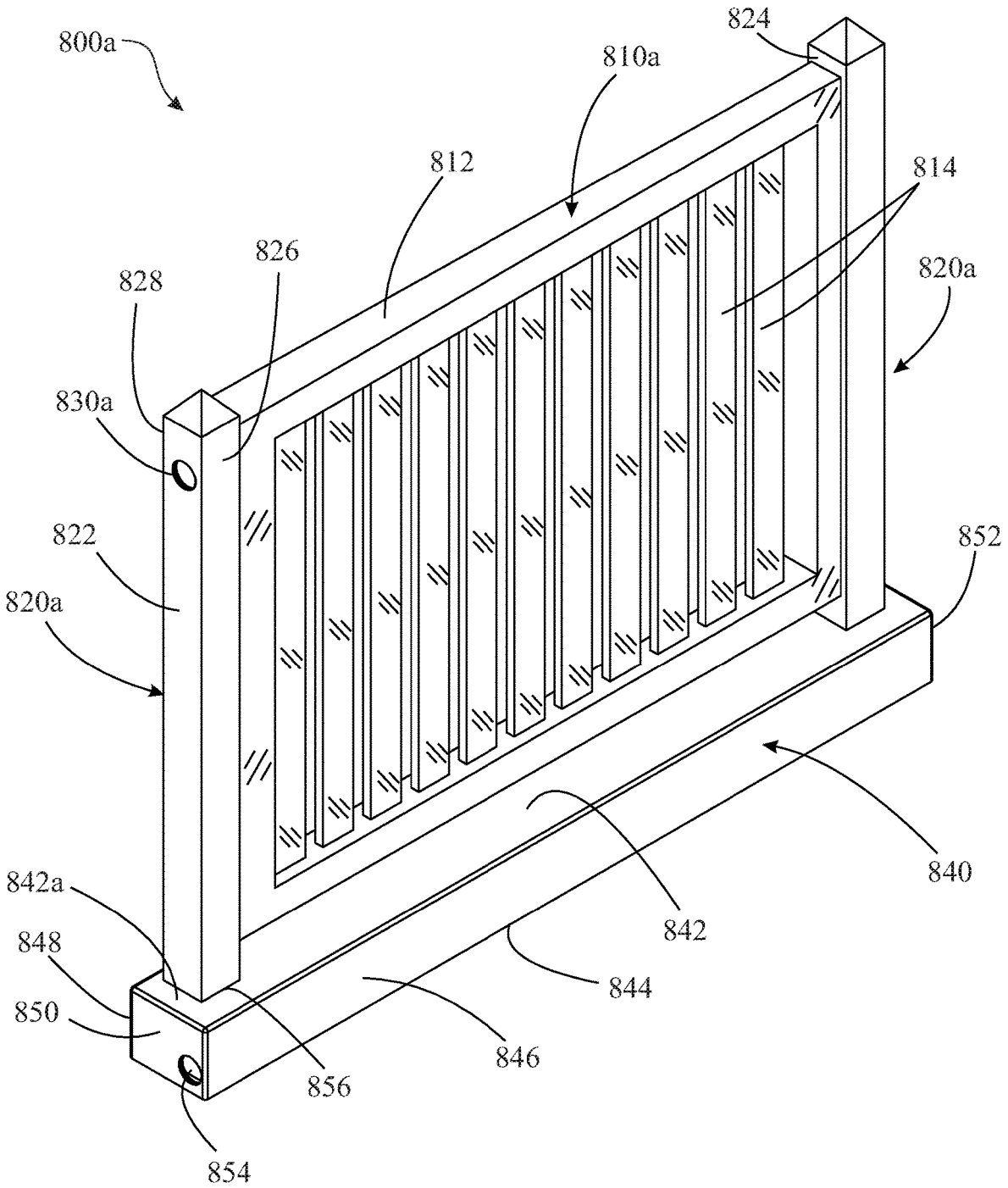
FIG. 20 presents a front-left-top isometric view of a unitary molded fence assembly in accordance with a further implementation of the present invention.
Figure 21:
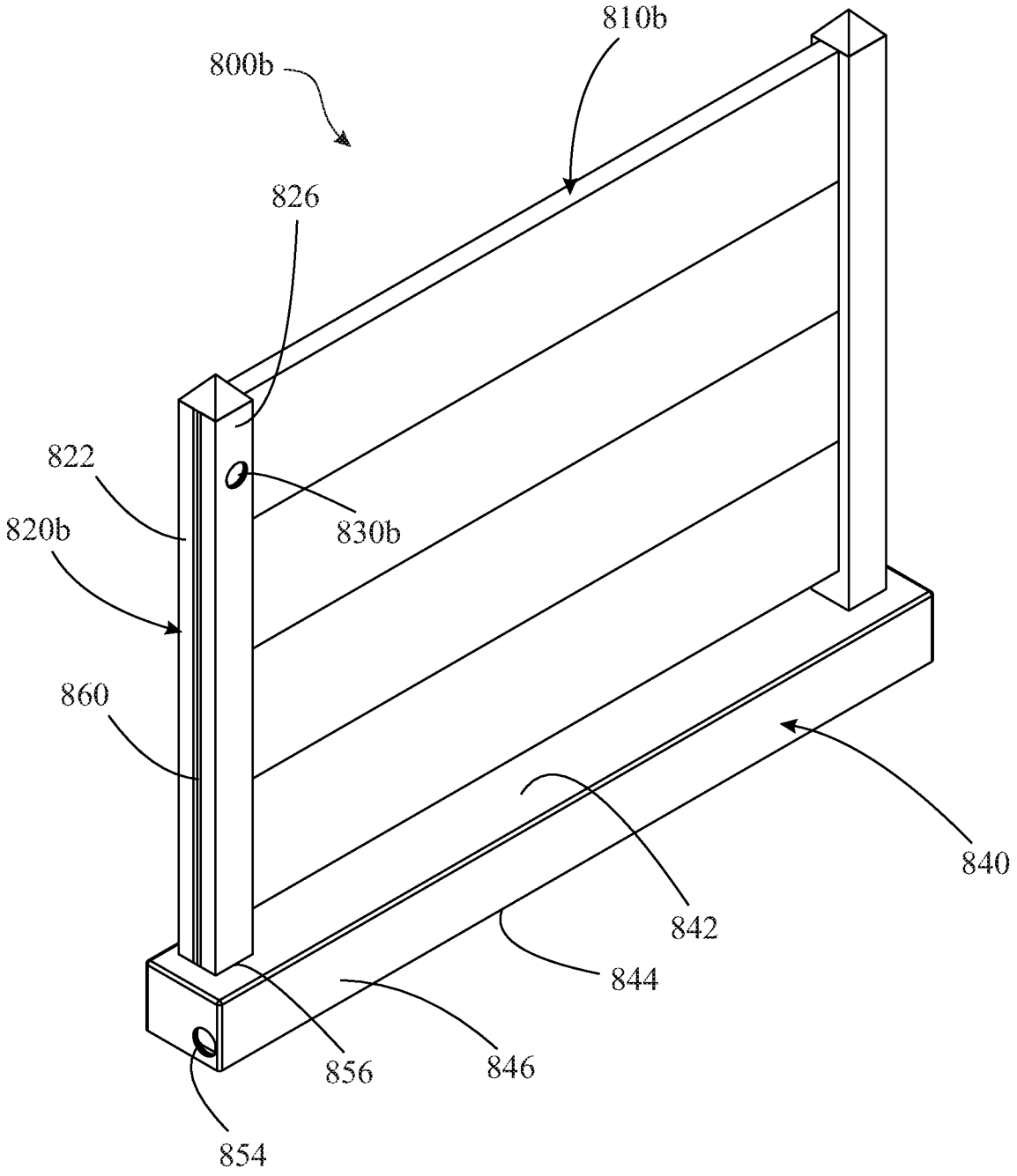
FIG. 21 presents a front-left-top isometric view of an alternative embodiment of the unitary molded fence assembly introduced in FIG. 20.
Figure 22:
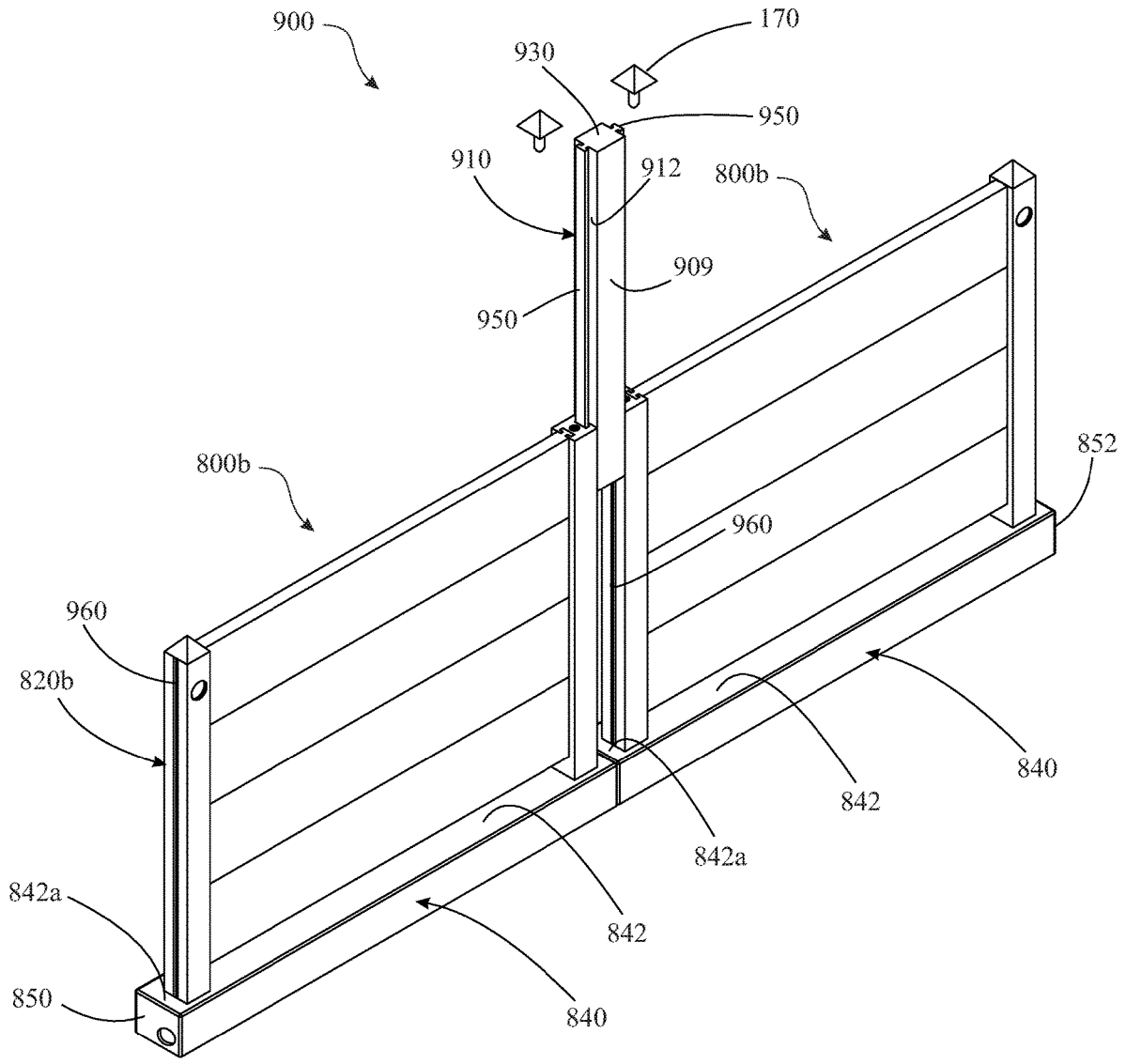
FIG. 22 present a front-left-top isometric view of a fence combination illustrating the use of a connector post 910, shown in a partially installed condition, to attach a pair of individual fence modular units **800*b*** in adjacent end-to-end fashion adjoined by the connector post.

Referring now to FIGS. 20-22, in accordance with an alternative implementation of the present invention a fence assembly in the form of a modular fence unit is shown at

800*a*. Significantly, modular fence unit 800*a* is provided as a unitary, or one-piece, molded structure. Referring particularly to FIG. 20, fence unit 800*a* includes a decorative central panel 810*a* that may incorporate a rectangular frame 812 and a plurality of spaced-apart fence pickets 814. At opposite lateral ends, the decorative central panel 810*a* transitions to a pair of water-fillable hollow end posts 820*a*, each having an exterior (i.e. outermost) end post side 822, an opposite interior end post side 824, a front end post side 826, and a rear end post side 828. The decorative panel 810*a* is contiguous with the hollow end posts 820*a*. At their upper ends, each end post 820*a* may incorporate a water inlet 830*a*, preferably in the form of a capped (not shown) aperture. The water inlet 830*a* is preferably provided extending completely through exterior end post side 828. However, as shown in the alternative implementation of FIG. 21, a water inlet 830*b* may be provided through front side 826 (or rear side 828). At their lower ends 856, each hollow end post 820*a* transitions to, and is contiguous with, a laterally-extending water-fillable hollow base 840. Significantly, for reasons described in more detail below, each of the end posts 820*a* are preferably provided inset a distance from the corresponding ends 850, 852 of base 840 such that an end portion of base upper side 842 defines a shoulder 842*a*.

Water-fillable hollow base 840 may be generally defined by an upper side 842, an opposite lower side 844, a front side 846, an opposite rear side 848, a left end 850 and an opposite right end 852, together defining a hollow interior space. At left end 850 (or right end 852), hollow base 840 may incorporate a water outlet 854, preferably in the form of a capped (not shown) aperture. The interior space of each hollow end post 820*a* is in fluid communication with the interior space of hollow-base 840. In this manner a user may cap base aperture 854 and then introduce water into end post 820*a* via water inlet 830*a* in order to completely fill base 840 and at least partially fill each end post 820*a* to accomplish secure ballasting of the fence unit.

Referring now to FIG. 21, in accordance with an alternative embodiment the modular fence unit 800*b* may incorporate a solid decorative central panel 810*b*. In that regard, the decorative central panel 810*a*, 810*b* of the present invention may incorporate any of myriad different decorative styles without departing from the intended scope of the invention. At opposite lateral ends, the decorative central panel 810*b* transitions to a pair of water-fillable hollow end posts 820*b*, each having an exterior (i.e. outermost) end post side 822, an opposite interior end post side 824, a front end post side 826, and a rear end post side 828. The decorative panel 810*b* is contiguous with the hollow end posts 820*b*. At their upper ends, each end post 820*b* may incorporate a water inlet 830*b*, preferably in the form of a capped (not shown) aperture extending through end post front side 826. The water inlet 830*b* is preferably provided extending completely through front end post side 826. At their lower ends 856, each hollow end post 820*b* transitions to, and is contiguous with, laterally-extending water-fillable hollow base 840. Significantly, in this embodiment each of the end posts 820*b* is provided with groove 860, or mateable female portion, having an identical configuration as that depicted in FIGS. 16-19. In this manner, as described in more detail below, multiple fence units 800*b* may be selectively adjoined in an end-to-end fashion in a manner similar to that described hereinabove with regard to FIG. 19.

Referring now to FIG. 22, a fence topology or architecture may be provided similar to that generally illustrated by reference character 400 in FIG. 19. In this manner, adjacent fence units 800*b* can be connected end-to-end with an intermediate connector post 910. A joint configuration, such as a tongue-and-groove combination, is used to releasably attach the connector post 910 to adjacent fence units 800*b* in the same manner as previously described above with respect to FIG. 19. For example, connector post 910 is fitted at both connection sides 912 opposite end posts 820*b* of adjacent fence units 800*b* with a male portion or tongue 950 that extends vertically along the length of connector post 910. As a counterpart to tongue 950, each end post 820*b* of adjacent fence units 800*b* includes a complementary and mateable female portion or groove 960 provided (e.g. formed during a molding operation) at an outer side facing opposite the side 912 of connector post 910 where tongue 950 is located. At both connection sides of connector post 910, tongue 950 is slidably and matingly insertable within grooves 960 of posts 820*b*, thereby connecting adjacent posts. In an alternative configuration, the male and female features can be switched, so that the male fitting is located on the posts 820*b*, and the female fitting is located on the connection post 910. The fencing architecture shown in FIG. 22 can be extended to include any number of interconnected fence units using the appropriate number of connector posts 910.

Since many modifications, variations, and changes in detail can be made to describe preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What is claimed is:

1. A fence assembly including at least one unitary modular fence unit, each at least one unitary modular fence unit comprising:

a laterally-extending hollow base having a left sidewall, a right sidewall, a front sidewall, a rear sidewall, a bottom sidewall, and a top sidewall, together, defining a laterally-extending hollow base interior space, the laterally-extending hollow base having an aperture extending through one of the left, right, front and rear sidewalls thereof for enabling the egress of water therefrom;

a first sealing cap sized and shaped for sealing engagement with the aperture of the laterally-extending hollow base;

a left end post extending upwardly from the top sidewall of the laterally-extending hollow base and inset a distance from the left sidewall thereof to define a left shoulder of the laterally-extending hollow base, the left end post defined by a contiguous sidewall extending between a closed upper end thereof and an open lower end thereof to define a left end post interior space, the open lower end of the left end post contiguous sidewall transitioning into, and contiguous with, the top sidewall of the laterally-extending hollow base, such that the interior space of the laterally-extending hollow base and the interior space of the left end post are in fluid communication with one another, the contiguous sidewall of the left end post having an aperture extending therethrough for enabling the ingress of water into the respective interior spaces of the left end post and the laterally-extending hollow base;

a second sealing cap sized and shaped for sealing engagement with the aperture of the left end post;

a right end post extending upwardly from the top sidewall of the laterally-extending hollow base and inset a distance from the right sidewall thereof to define a right shoulder of the laterally-extending hollow base, the right end post defined by a contiguous sidewall extending between a closed upper end thereof and an open lower end thereof to define a right end post interior space, the open lower end of the right end post contiguous sidewall transitioning into, and contiguous with, the top sidewall of the laterally-extending hollow base, such that the interior space of the laterally-extending hollow base and the interior space of the right end post are in fluid communication with one another, the contiguous sidewall of the right end post having an aperture extending therethrough for enabling the ingress of water into the respective interior spaces of the right end post and the laterally-extending hollow base;

a third sealing cap sized and shaped for sealing engagement with the aperture of the right end post; and a decorative central panel spanning the respective left and right end posts, left and right ends of the decorative central panel each having a first half of a tongue-and-groove mechanical fastening system extending longitudinally therealong, wherein:

the contiguous sidewall of the left end post further comprises an exterior-facing side and an opposite interior-facing side, the interior-facing side of the left end post having a second half of the tongue-and-groove mechanical fastening system extending longitudinally therealong for enabling sliding engagement with the first half of the tongue-and-groove mechanical fastening system extending longitudinally along the left end of the decorative central panel;

the contiguous sidewall of the right end post further comprises an exterior-facing side and an opposite interior-facing side, the interior-facing side of the right end post having a second half of the tongue-and-groove mechanical fastening system extending longitudinally therealong for enabling sliding engagement with the first half of the tongue-and-groove mechanical fastening system extending longitudinally along the right end of the decorative central panel; and the exterior-facing side of at least one of the left and right end posts has a first half of a tongue-and-groove mechanical fastening system provided extending longitudinally therealong.

2. The fence assembly recited in claim 1 wherein said at least one unitary modular fence unit further comprises a pair of left and right unitary modular fence units oriented and positioned in an end-to-end configuration, such that the right end of the laterally-extending hollow base of the left unitary modular fence unit and the left end of the laterally-extending hollow base of the right unitary modular fence unit abut one another.

3. The fence assembly recited in claim 2, further comprising an intermediate connector post for adjoining the right end post of the left unitary modular fence unit with the left end post of the right unitary modular fence unit, the intermediate connector defined by a front side, a rear side, a left side, a right side, an upper end, and a lower end, wherein the left and right sides of the intermediate connector post each has a second half of a tongue-and-groove mechanical fastening system extending longitudinally therealong, such that the intermediate connector post may be slidably inserted between respective opposing exterior-facing sides of the right end post of the left unitary modular fence unit and the left end post of the right unitary modular fence unit to selectively interlock the left and right unitary modular fence units to one another.

4. The fence assembly recited in claim 3, wherein upon slidably inserting the intermediate connector post between the opposing exterior surfaces of the right end post of the left unitary modular fence unit and the left end post of the right unitary modular fence unit to selectively interlock the left and right unitary modular fence units to one another, the lower end of the intermediate connector post is supported upon the hollow base right shoulder of the left unitary modular fence unit and the hollow base left shoulder of the right unitary modular fence unit.

5. The fence assembly recited in claim 4, wherein upon slidably inserting the intermediate connector post between the opposing exterior-facing surfaces of the right end post of the left unitary modular fence unit and the left end post of the right unitary modular fence unit to selectively interlock the left and right unitary modular fence units to one another, a front surface of the intermediate connector post is flush with a corresponding front surface of the right end post of the left unitary modular fence unit and with a front surface of the left end post of the right unitary modular fence unit.

6. The fence assembly recited in claim 4, wherein upon slidably inserting the intermediate connector post between the opposing exterior-facing surfaces of the right end post of the left unitary modular fence unit and the left end post of the right unitary modular fence unit to selectively interlock the left and right unitary modular fence units to one another, a rear surface of the intermediate connector post is flush with a corresponding rear surface of the right end post of the left unitary modular fence unit and with a rear surface of the left end post of the right unitary modular fence unit.

* * * * *